US009259370B2

(12) United States Patent
Gabriely et al.

(10) Patent No.: US 9,259,370 B2
(45) Date of Patent: Feb. 16, 2016

(54) WHEELCHAIR AND A METHOD FOR PRODUCING SAID WHEELCHAIR

(75) Inventors: Yoav Gabriely, Yokneam Ilit (IL); Ruth Reuveni, Ramot (IL)

(73) Assignee: Zriha Hlavin Industries Ltd., Barkan (IL)

( * ) Notice: Subject to any disclaimer, the term of this patent is extended or adjusted under 35 U.S.C. 154(b) by 254 days.

(21) Appl. No.: 13/358,527

(22) Filed: Jan. 26, 2012

(65) Prior Publication Data

US 2013/0154231 A1 Jun. 20, 2013

Related U.S. Application Data

(63) Continuation-in-part of application No. PCT/IB2010/053413, filed on Jul. 27, 2010.

(30) Foreign Application Priority Data

Jul. 27, 2009 (IL) ..... 200080

(51) Int. Cl.

| | |
|---|---|
| ***A61G 5/00*** | (2006.01) |
| ***A61G 5/02*** | (2006.01) |
| ***A61G 5/08*** | (2006.01) |
| ***A61G 5/10*** | (2006.01) |
| *A61G 5/12* | (2006.01) |

(52) U.S. Cl.

CPC .. *A61G 5/08* (2013.01); *A61G 5/00* (2013.01); *A61G 5/02* (2013.01); *A61G 5/1002* (2013.01); *A61G 2005/0808* (2013.01); *A61G 2005/0816* (2013.01); *A61G 2005/0866* (2013.01); *A61G 2005/0883* (2013.01); *A61G 2005/0891* (2013.01); *A61G 2005/128* (2013.01)

(58) Field of Classification Search

CPC ..... A61G 2005/1054; A61G 2005/0808; A61G 5/02; A61G 5/08; B62M 1/14

USPC ..... 280/250.1, 304.1, 647

See application file for complete search history.

(56) References Cited

U.S. PATENT DOCUMENTS

| | | | | |
|---|---|---|---|---|
| 531,330 | A * | 12/1894 | Potter | 280/211 |
| 2,681,689 | A * | 6/1954 | Breed | 108/44 |
| 2,896,693 | A * | 7/1959 | Gert | 280/42 |

(Continued)

FOREIGN PATENT DOCUMENTS

| | | | | |
|---|---|---|---|---|
| DE | 3110687 | A1 * | 1/1983 | A61G 5/02 |
| DE | 102007001328 | A1 * | 7/2008 | B60B 19/00 |

(Continued)

*Primary Examiner* — Anne Marie Boehler
*Assistant Examiner* — Maurice Williams
(74) *Attorney, Agent, or Firm* — Mark M. Friedman

(57) ABSTRACT

A collapsible wheelchair (CW) may be relatively small and lightweight and may be adapted to be easily collapsed/folded into a callable faint, allowing for easy storage, transport and use. The CW may be adapted to be collapsed/folded and expanded/unfolded in a series of simple steps, executable with one hand, by a person in a seated position, allowing for independent use even by a user with limited physical capabilities. The CW may have a relatively small width, allowing for access into constricted spaces. The rear and interior space between its large wheels may be unobstructed, leaving an unobstructed inner width, allowing the CW to be maneuvered in reverse over standing objects, such as a standard toilet. The seat of the CW may be equipped with a trap door, to allow the use of a toilet while seated on the CW. The rim may be beneath the seat for cleanliness.

10 Claims, 42 Drawing Sheets

(56) References Cited

U.S. PATENT DOCUMENTS

| | | | | | |
|---|---|---|---|---|---|
| 3,618,968 | A | * | 11/1971 | Greer | 280/47.11 |
| 4,527,829 | A | | 7/1985 | Fanslau et al. | |
| 4,607,860 | A | | 8/1986 | Vogel | |
| 4,693,490 | A | * | 9/1987 | Loodberg et al. | 280/650 |
| 4,754,987 | A | * | 7/1988 | Williams | 280/304.1 |
| 4,770,432 | A | * | 9/1988 | Wagner | 280/250.1 |
| 5,101,536 | A | * | 4/1992 | Gabriele | 16/386 |
| 5,261,684 | A | * | 11/1993 | Soto | 280/250.1 |
| 5,388,289 | A | * | 2/1995 | Casperson | 5/86.1 |
| 5,445,433 | A | * | 8/1995 | Avihod | 297/380 |
| 5,490,719 | A | * | 2/1996 | Lew | 301/5.1 |
| 5,573,261 | A | * | 11/1996 | Miller | 280/250.1 |
| 5,577,753 | A | | 11/1996 | Pociask | |
| 5,857,688 | A | * | 1/1999 | Swearingen | 280/250.1 |
| 6,003,171 | A | * | 12/1999 | Jones, Jr. | 4/667 |
| 6,135,475 | A | * | 10/2000 | Brown et al. | 280/250.1 |
| 6,209,901 | B1 | | 4/2001 | Patel | |
| 6,276,704 | B1 | * | 8/2001 | Suiter | 280/250.1 |
| 6,338,493 | B1 | * | 1/2002 | Wohlgemuth et al. | 280/30 |
| 6,533,358 | B1 | * | 3/2003 | Avihod | 297/380 |
| 6,623,022 | B2 | * | 9/2003 | Malassigne et al. | 280/250.1 |
| 7,243,938 | B2 | * | 7/2007 | Stamps et al. | 280/304.1 |
| 7,694,990 | B2 | * | 4/2010 | Goertzen et al. | 280/304.1 |
| 8,522,907 | B1 | * | 9/2013 | Irvine | 180/208 |
| 8,573,622 | B2 | * | 11/2013 | Papi et al. | 280/250.1 |
| 2002/0024196 | A1 | | 2/2002 | Malassigne et al. | |
| 2002/0125711 | A1 | * | 9/2002 | Calhoun | 280/848 |
| 2003/0030251 | A1 | | 2/2003 | Malassigne et al. | |
| 2005/0022296 | A1 | | 2/2005 | Jensen | |
| 2006/0197302 | A1 | * | 9/2006 | Meginniss et al. | 280/250.1 |
| 2007/0040348 | A1 | * | 2/2007 | Erickson | 280/250.1 |
| 2008/0106060 | A1 | * | 5/2008 | Knopf | 280/250.1 |
| 2008/0111338 | A1 | | 5/2008 | Ilan | |
| 2008/0208394 | A1 | * | 8/2008 | Fought | 701/1 |
| 2008/0309047 | A1 | * | 12/2008 | Moran et al. | 280/250.1 |
| 2012/0056404 | A1 | * | 3/2012 | Rousseau | 280/304.1 |
| 2013/0197732 | A1 | * | 8/2013 | Pearlman et al. | 701/22 |

FOREIGN PATENT DOCUMENTS

| | | | | | |
|---|---|---|---|---|---|
| GB | 820651 | | * | 9/1959 | A61G 5/12 |
| WO | WO 2004016210 | A1 | * | 2/2004 | A61G 5/02 |

* cited by examiner

Figure 2F
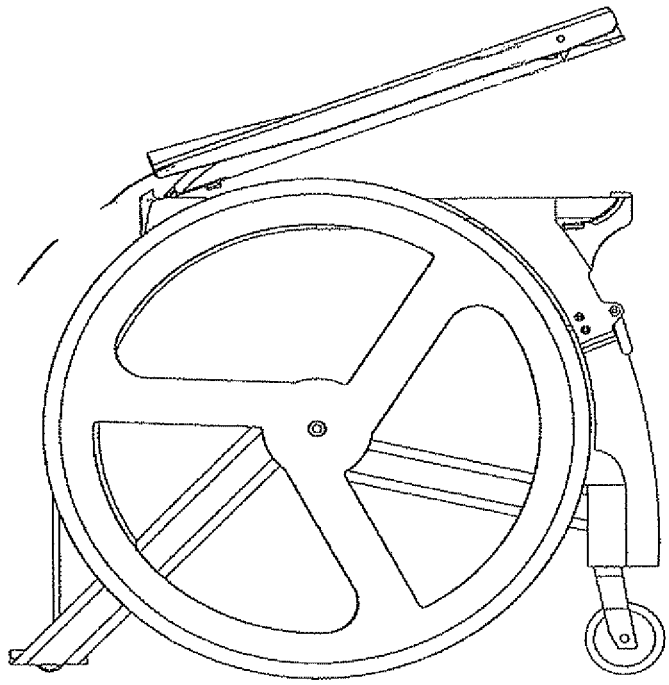
500
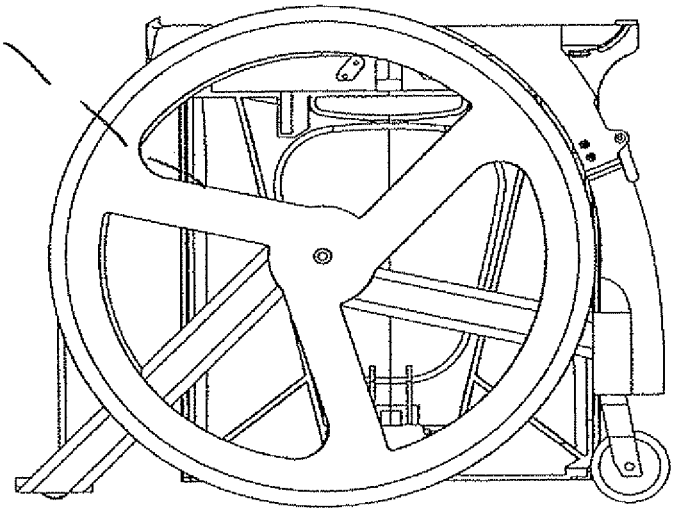
Figure 2G

FIGURE 4C
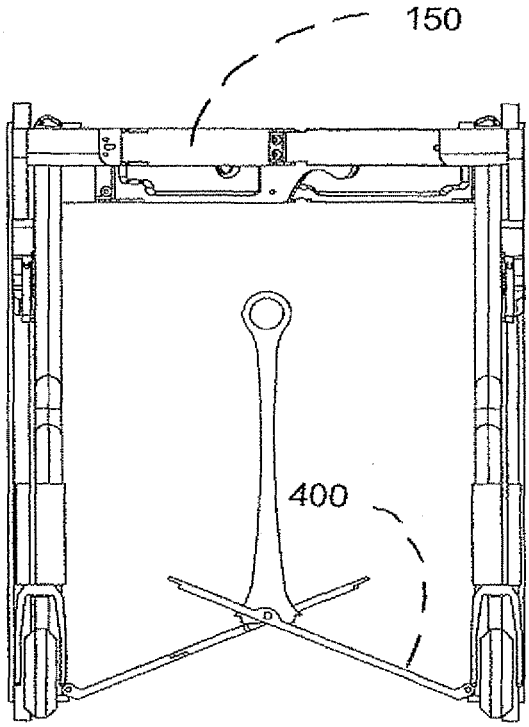
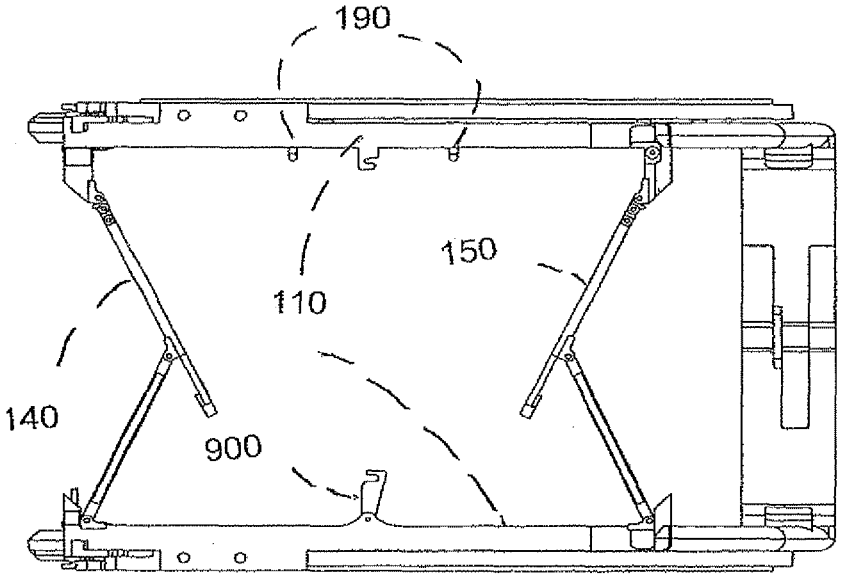

Figure 6E
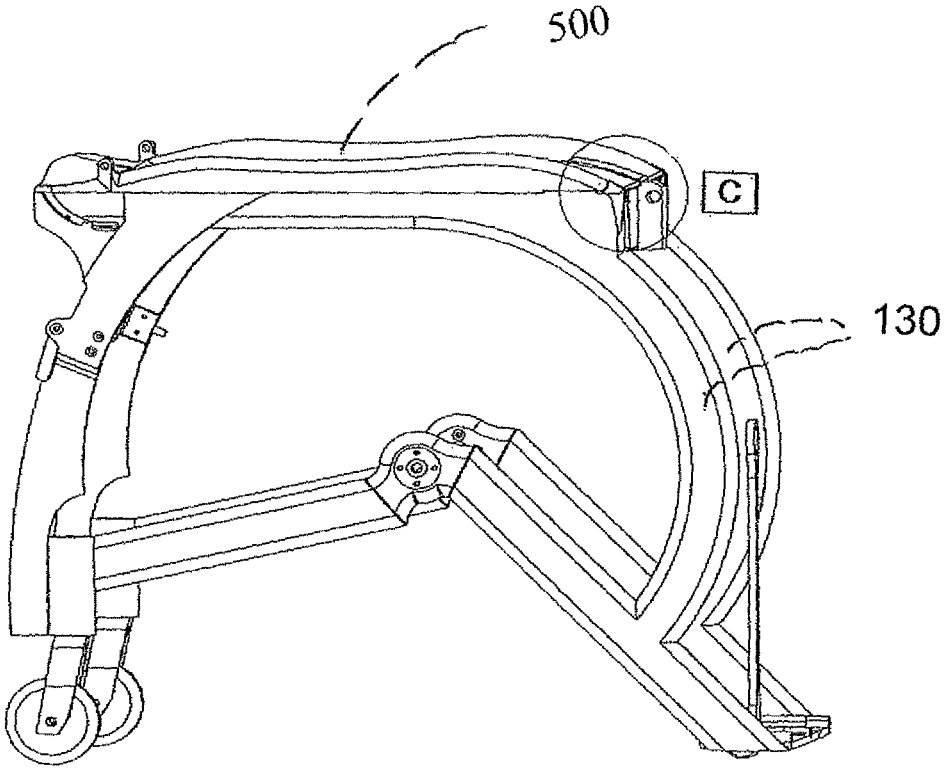
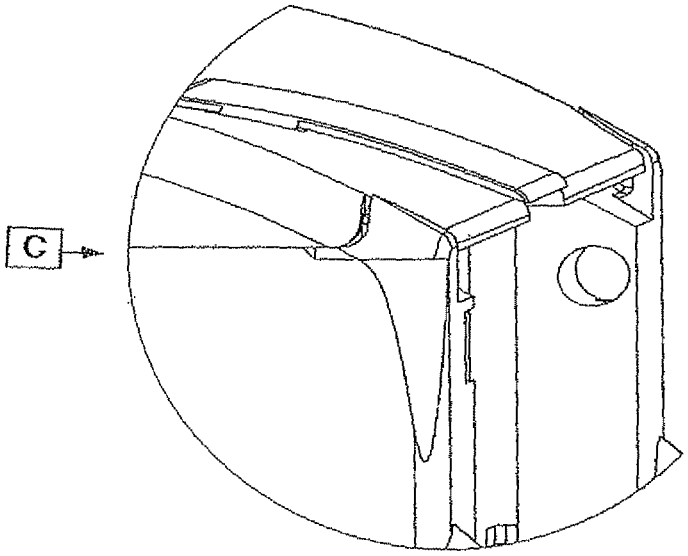

FIGURE 6F
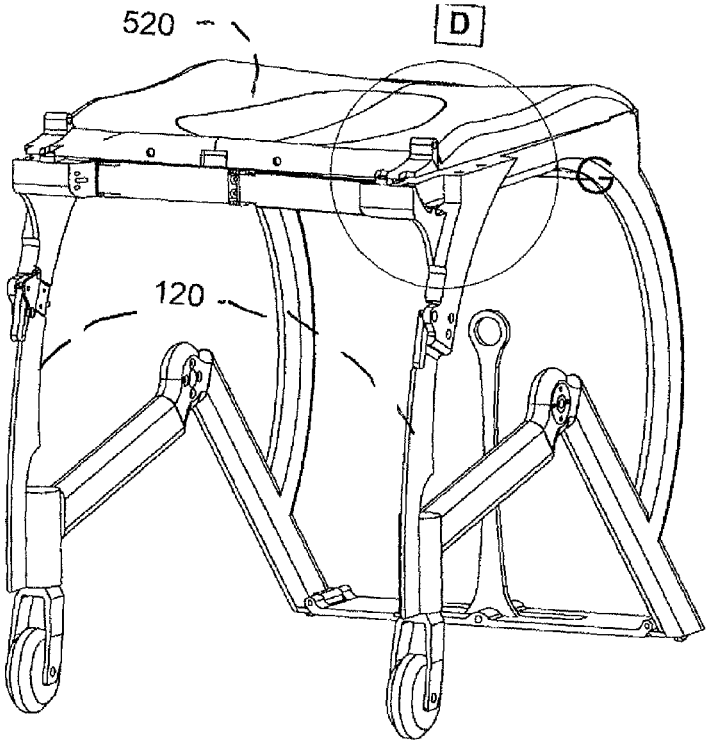
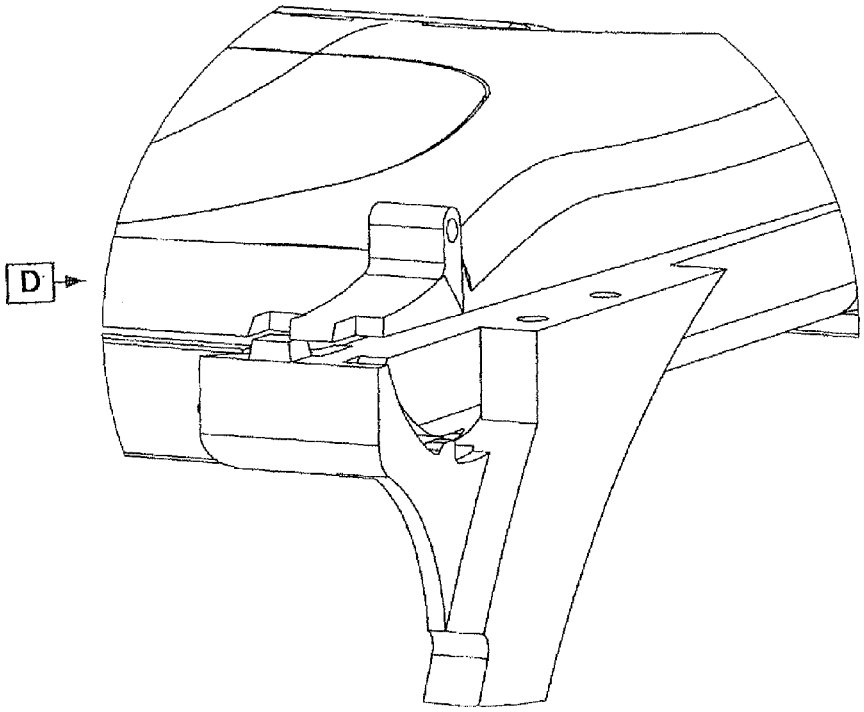

FIGURE 8A- DETAIL F
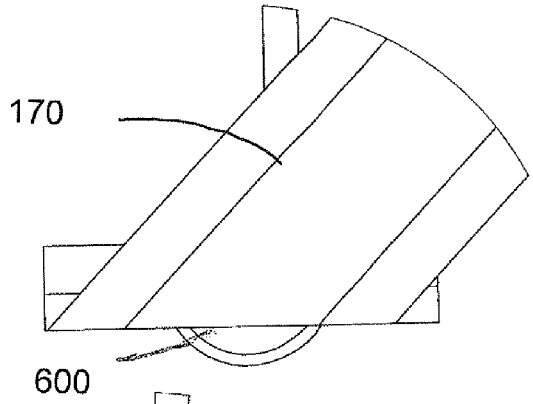
FIGURE 8A*-DETAIL F
*Embodiment
without front wheels
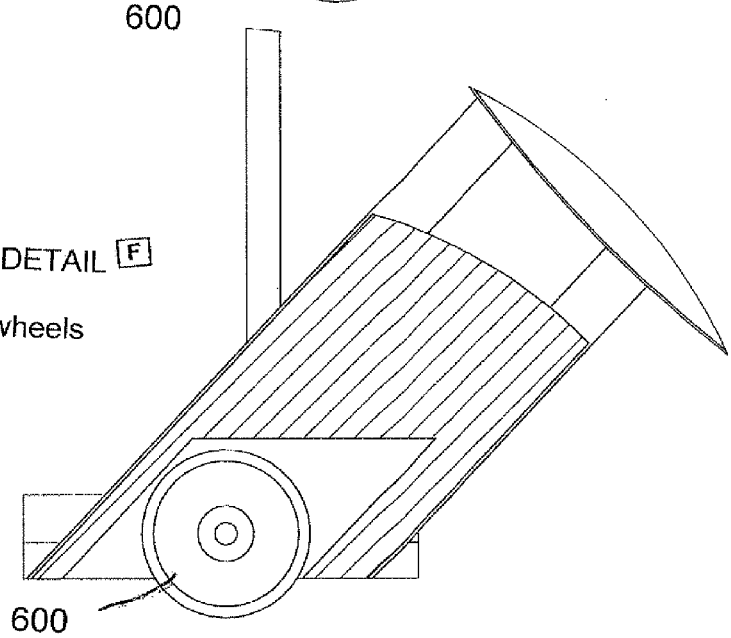
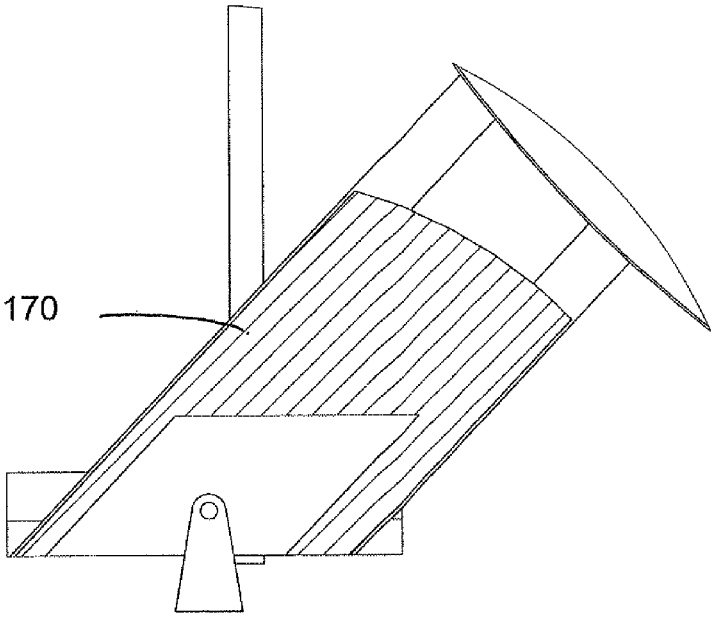

WHEELCHAIR AND A METHOD FOR PRODUCING SAID WHEELCHAIR

PRIORITY CLAIMS

This is a CIP of PCT/IB2010/053413, which claims priority from Israeli Patent Application No. 200080, invented by the inventors of the present application and titled: "Singular Wheelchair", filed Jul. 27, 2009.

FIELD OF THE INVENTION

The present invention generally relates to the field of accessories for handicapped persons. More specifically, the present invention relates to a wheelchair.

BACKGROUND

A wheelchair is a chair with wheels, designed to be a replacement for walking. The device comes in variations where it's propelled by motors or by the seated occupant turning the rear wheels by hand. Often there are handles behind the seat for someone else to do the pushing. Wheelchairs are used by people for whom walking is difficult or impossible due to illness (physiological or physical), injury, or disability. The earliest record of wheelchairs dates back to the 6th century, as an inscription found on a stone slate in China. Later dates relate to Europeans using this technology during the German Renaissance. Harry Jennings and his disabled friend Herbert Everest, both mechanical engineers, invented the first lightweight, steel, collapsible wheelchair in 1933. Mr Everest had broken his back in a mining accident. The two saw the business potential of the invention and went on to become the first mass-manufacturers of wheelchairs: Everest and Jennings. Their "x-brace" design is still in common use, albeit with updated materials and other improvements.

A basic manual wheelchair incorporates a seat, foot rests, handles at the back and four wheels: two castor wheels at the front and two large wheels at the back. Although the use of a wheelchair greatly increases the mobility and independence of a person with limited physical abilities, the current design of wheelchairs, described above, still leaves a user with many limitations.

One of the major limitations for a person confined to a wheelchair involves access to facilities and areas designed for use by persons of normal physical abilities. The size and maneuvering capabilities of a wheelchair often do not conform to the physical constraints of such facilities. The wheelchair may be too wide to fit in many passages, the turning radius of the wheelchair may be too large for some of the turns, the wheelchair may be unable to traverse certain obstacles (particularly standing obstacles), and so on. As a result, many modern facilities are designed to allow access to wheelchairs, i.e. are designed with wheelchair limitations in mind, and there are even laws requiring many facilities intended for public use to provide for wheelchair access. Nevertheless, a person confined to a wheelchair often encounters situations where the physical limitations of the wheelchair inhibit or even prevent his/her access to facilities or areas he/she wishes to enter, use or traverse. This is often true of private residences or older facilities. Moreover, even in those locations that provide for wheelchair access, the use of these provisions may be cumbersome or unpleasant.

Of particular concern is access to toilet facilities, which is often especially difficult and unpleasant for persons confined to a wheelchair. Not only are most toilets inaccessible for a standard wheelchair, even those that are require the person to transfer himself from the wheelchair to the toilet seat and/or require the intimate assistance of a third party.

It would therefore be desirable to provide a wheelchair adapted to conform to the physical constraints of facilities and areas designed for use by normal persons (especially toilet facilities), while still allowing independent use by a person confined to a wheelchair. Such a wheelchair would be especially useful if it is further adapted to be easy to store, transport and use by a person with limited physical abilities and would be yet more useful if it allowed a person seated on it to use a toilet facility without transferring himself/herself onto the toilet seat.

SUMMARY OF THE INVENTION

The present invention is a wheelchair (hereinafter: "CW") comprising:

a. a chassis [100] comprised of multiple rigid bars connected by multiple joints adapted to facilitate the collapsing/folding of the CW;

b. two large driving wheels [200] which may be attached to the chassis approximately at its center [see FIG. 5B+C-#180];

c. two small rear wheels [300] which may be attached to the rear of the chassis [see FIG. 8A];

d. a legrest [400] which may be attached to both sides of the lower front portion of the chassis [see FIG. IA], may include a folding joint [FIG. 7A-#475] adapted to facilitate the collapsing/folding of the CW and may further include a handle [450] adapted to facilitate the folding of the legrest joint;

e. a detachable folding seat and backrest assembly/component [500] (hereinafter: "SBC") which may be adapted to be stored inside the chassis in its folded state [see FIG. 6J], adapted to detachably connect to the top of the chassis in its open state [see FIG. 6B-6H] and may include an opening, which may be covered by a trap door [540];

f. two small wheels [600] attached to the bottom of the legrest;

g. detachable optional armrests [700]; and/or h. miscellaneous connectors and other auxiliary parts.

According to some embodiments of the present invention, the wheelchair may include one or more of the following features:

a. the wheelchair may be no more than 50 cm wide at its widest point;

b. the wheelchair, when in a collapsed state, may be:
no more than 60 cm wide;
no more than 70 cm long; and
no more than 20 cm thick;

c. the width of the wheelchair, in its open state may be no more than 10% greater than the distance between the seat and the ground;

d. the length of the wheelchair may be no more than 40% greater than the distance between the seat and the ground;

e. when a user is seated on the wheelchair the center of gravity of the wheelchair may be located at a point between the hubs of the driving wheels or behind said point;

f. the center of the minimal enclosing circle of the wheelchair may be located substantially between the driving wheels.

g. the chassis may be collapsible;

h. the wheelchair may be adapted to be collapsed and expanded by a user seated next to said wheelchair;

i. the space between the sides of the chassis, below the seat [190], may be unobstructed from the rear up to the legrest.

j. the chassis and wheels may be arranged such that the wheelchair can be maneuvered backwards over a standard toilet by a user seated on the wheelchair;

k. the seat of the wheelchair may be substantially level with the top of the driving wheels;

l. the driving wheels may be laterally supported by at least one contact point between the rim of said wheels and a portion of the chassis;

m. portions of the chassis adjacent to the upper half portion of the driving wheels may have a contour corresponding to the contour of the rim of the driving wheels;

n. one or more of the spokes of each of the driving wheels may be adapted to serve as a handle/grip for rotating each of the driving wheels such that the wheelchair is propelled;

o. the space behind the spokes of the driving wheels corresponding to the upper portion of the driving wheels [166] may be unobstructed.

p. the SBC may inhibit collapse of the chassis when connected to said chassis;

q. the weight of a user seated on the SBC may inhibit folding of the SBC, when the SBC is connected to the chassis; and/or r. The SBC may further comprise a mechanism for opening the trap door;

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

FIGS. IA+IB: are diagrams of an exemplary CW, from different angles, in accordance with some embodiments of the present invention.

FIG. ID: includes diagrams of an exemplary CW, from different angles, in accordance with some embodiments of the present invention.

FIGS. 2A-2L: are diagrams of an exemplary CW, in different stages of collapsing/folding of the exemplary CW, all in accordance with some embodiments of the present invention.

Figure 3A:
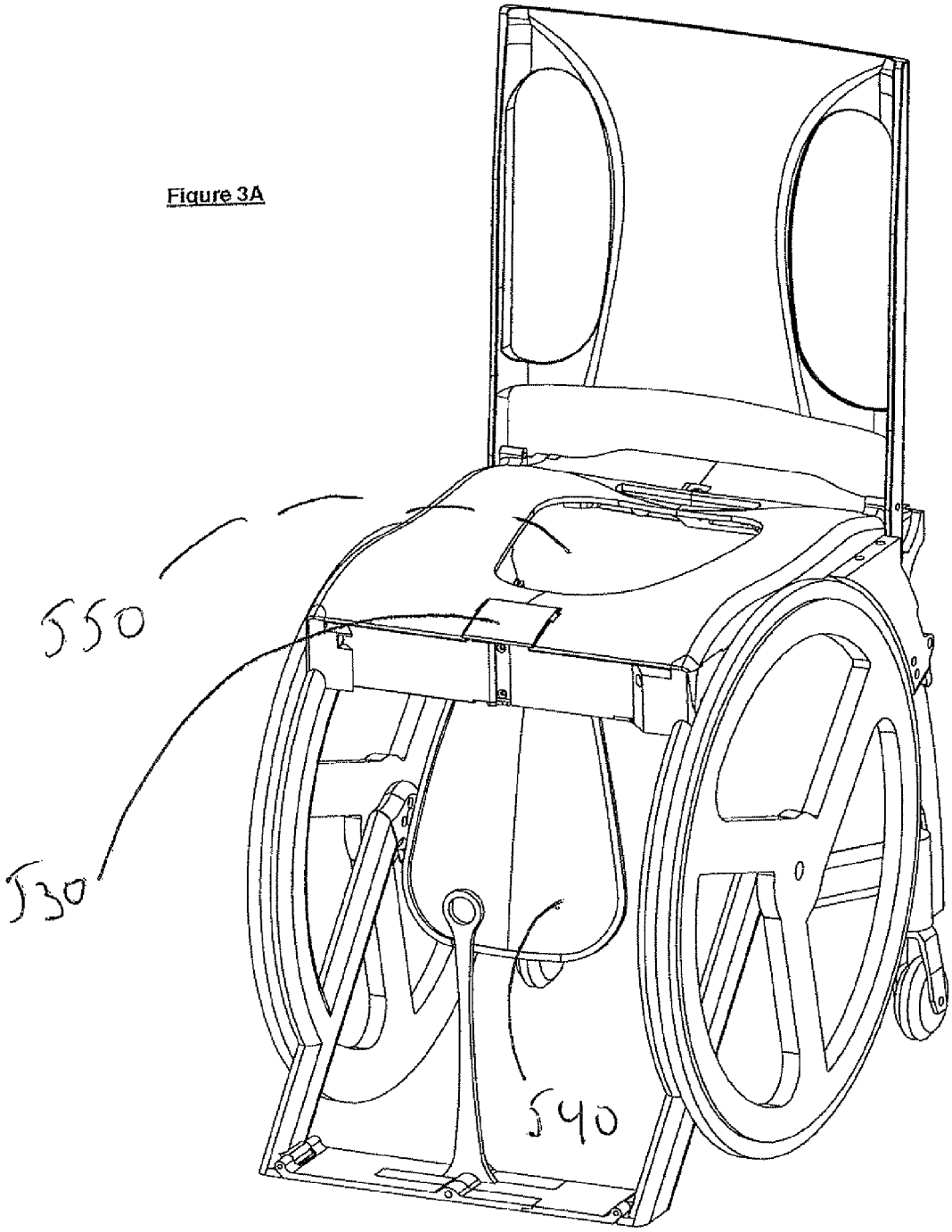

FIG. 3A: is a diagram of an exemplary CW, with an open trap door, in accordance with some embodiments of the present invention.

Figure 3B:
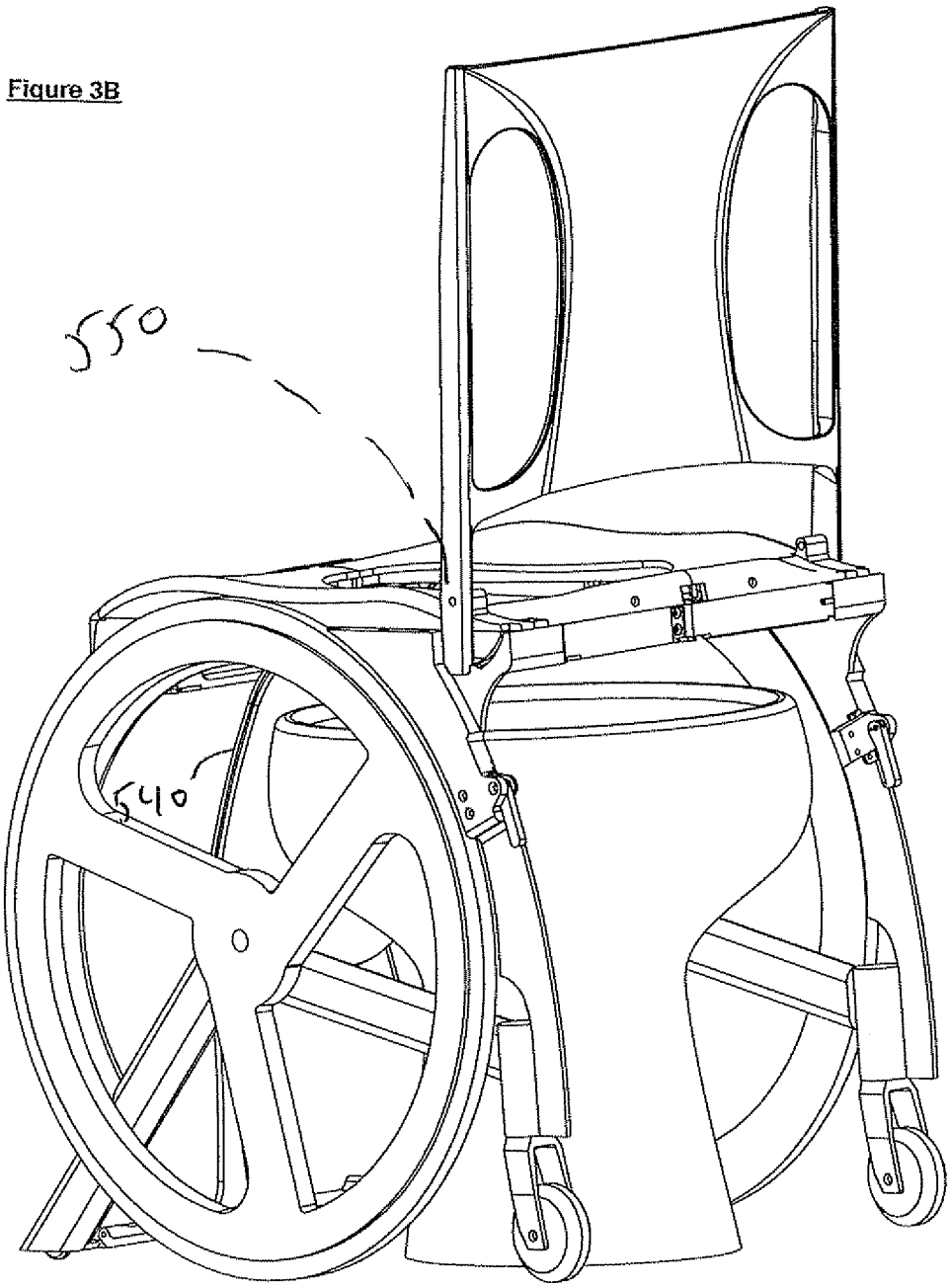

FIG. 3B: is a diagram of an exemplary CW, standing over a standard toilet, in accordance with some embodiments of the present invention.

Figure 3C:
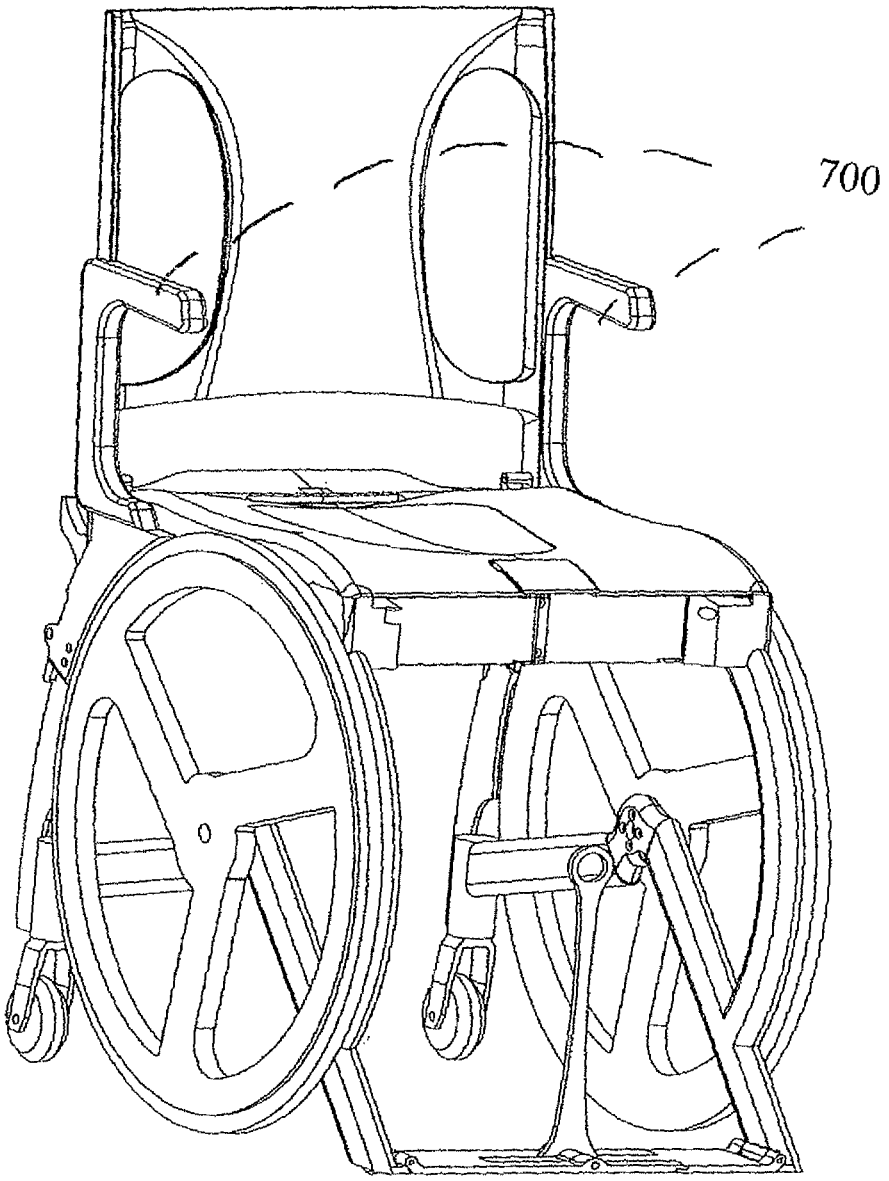

FIG. 3C: is a diagram of an exemplary CW, with optional armrests attached, in accordance with some embodiments of the present invention.

FIGS. 4A-4D: are diagrams of a chassis, of an exemplary CW, with driving wheels attached, in different stages of collapsing of the chassis, all in accordance with some embodiments of the present invention.

Figure 5A:
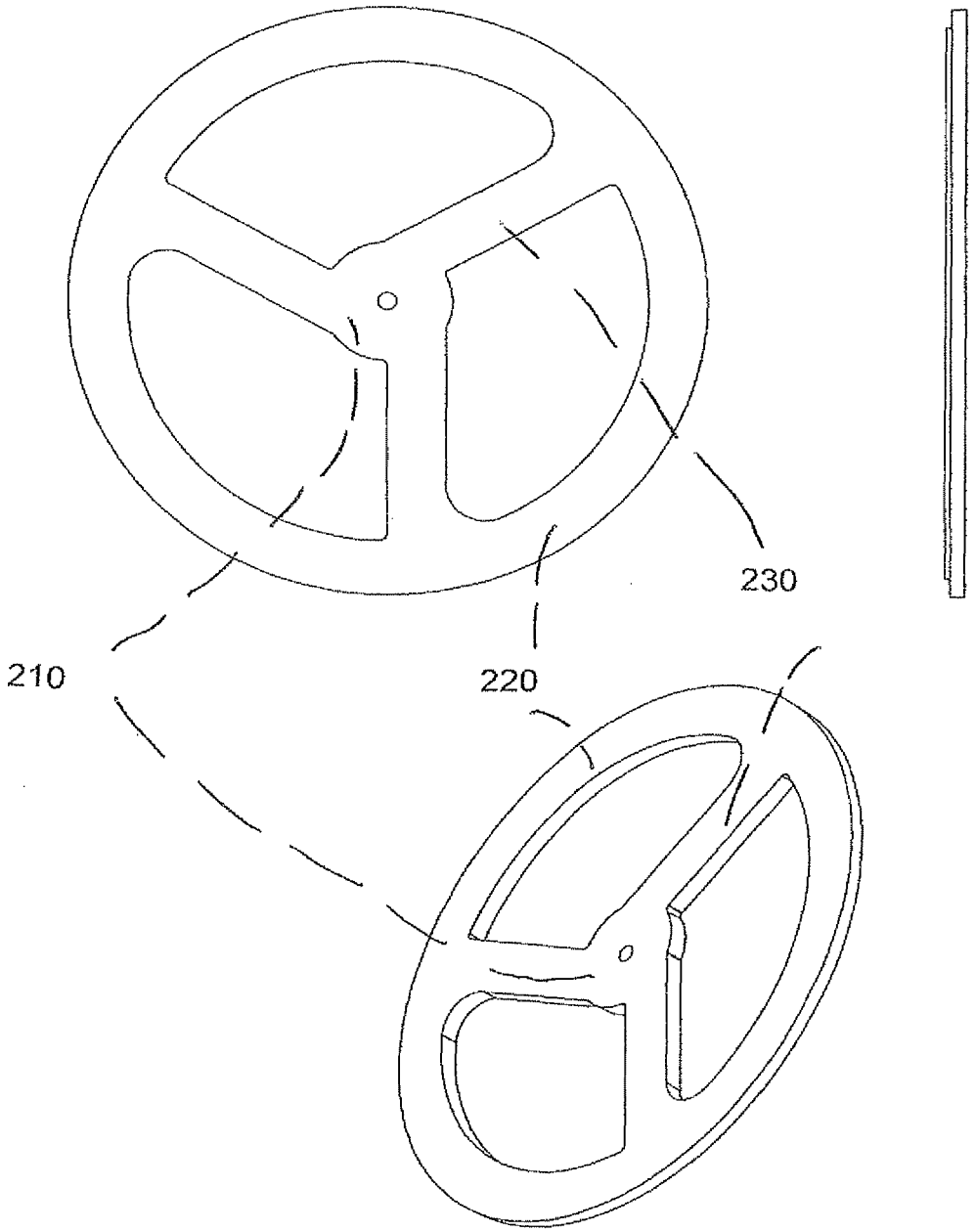

FIG. 5A: is a diagram of a driving wheel of an exemplary CW, from different angles, in accordance with some embodiments of the present invention.

Figure 5B:
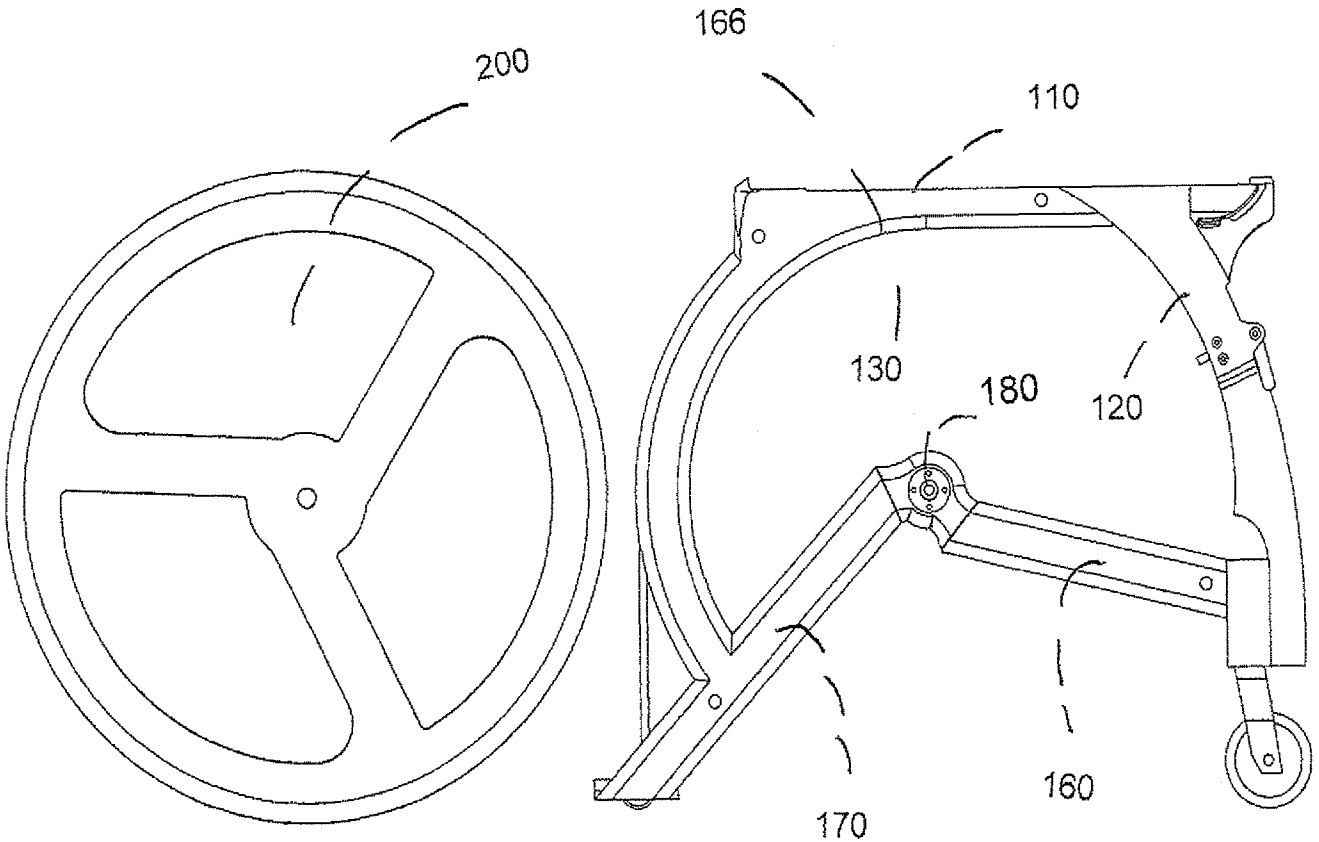

FIG. 5B: is a diagram of a driving wheel of an exemplary CW side by side with a side of a chassis of an exemplary CW where the wheel is intended to connect, in accordance with some embodiments of the present invention.

Figure 5C:
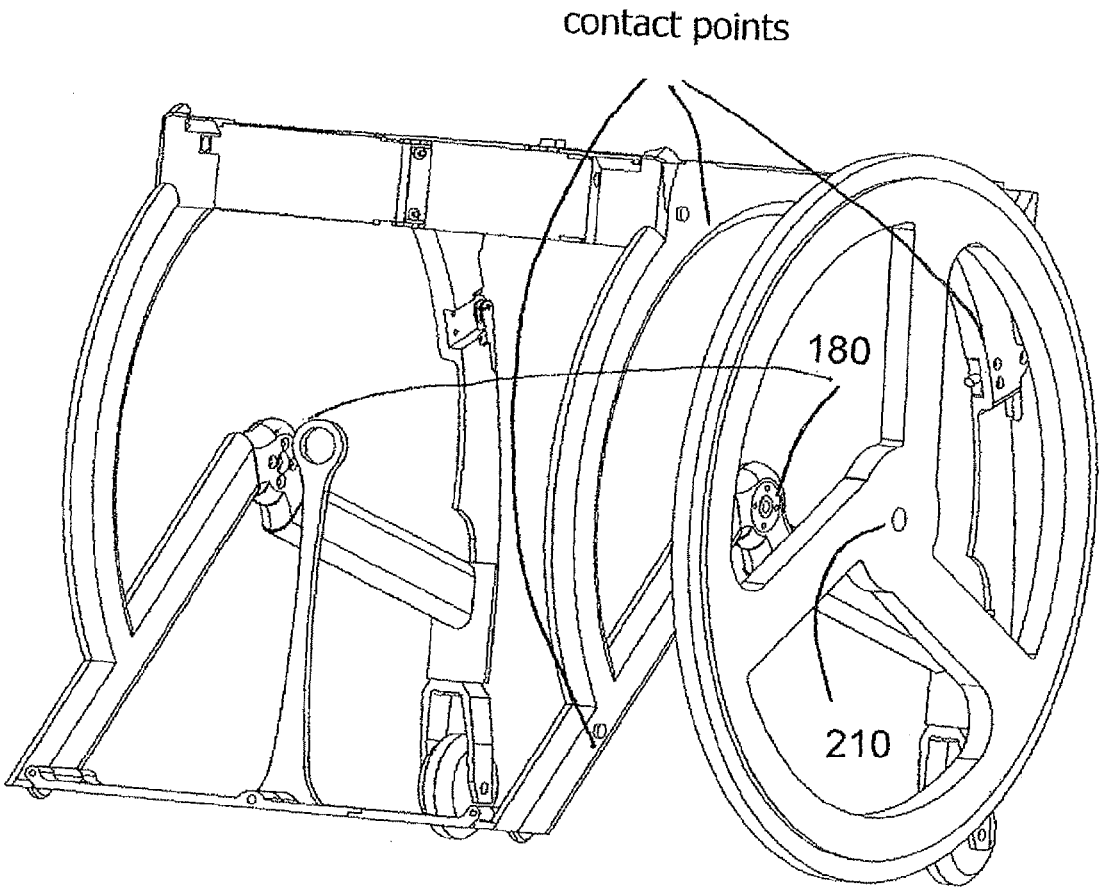

FIG. 5C: is a diagram of a driving wheel of an exemplary CW slightly separated from the side of a chassis of an exemplary CW where the wheel is intended to connect, in accordance with some embodiments of the present invention.

Figure 5D:
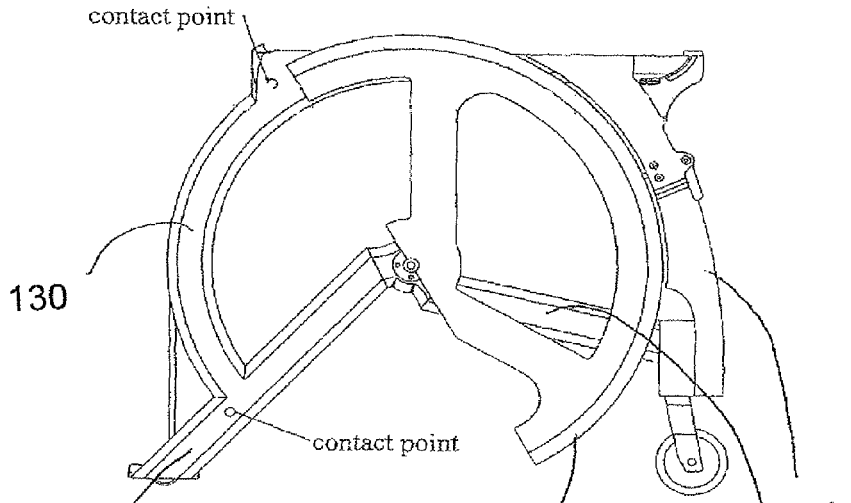
Figure 5E:
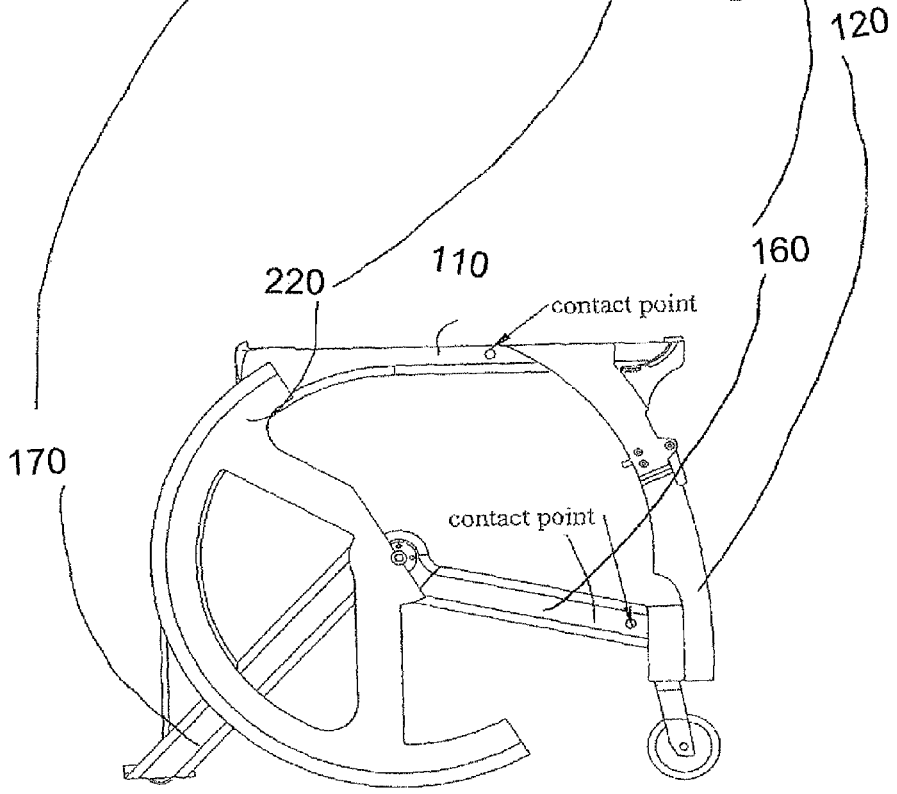

FIGS. 5D-5E: are diagrams of a driving wheel of an exemplary CW connected to a side of a chassis of an exemplary CW, wherein portions of the wheel are cutaway to show contact points with the chassis, in accordance with some embodiments of the present invention.

Figure 6A:
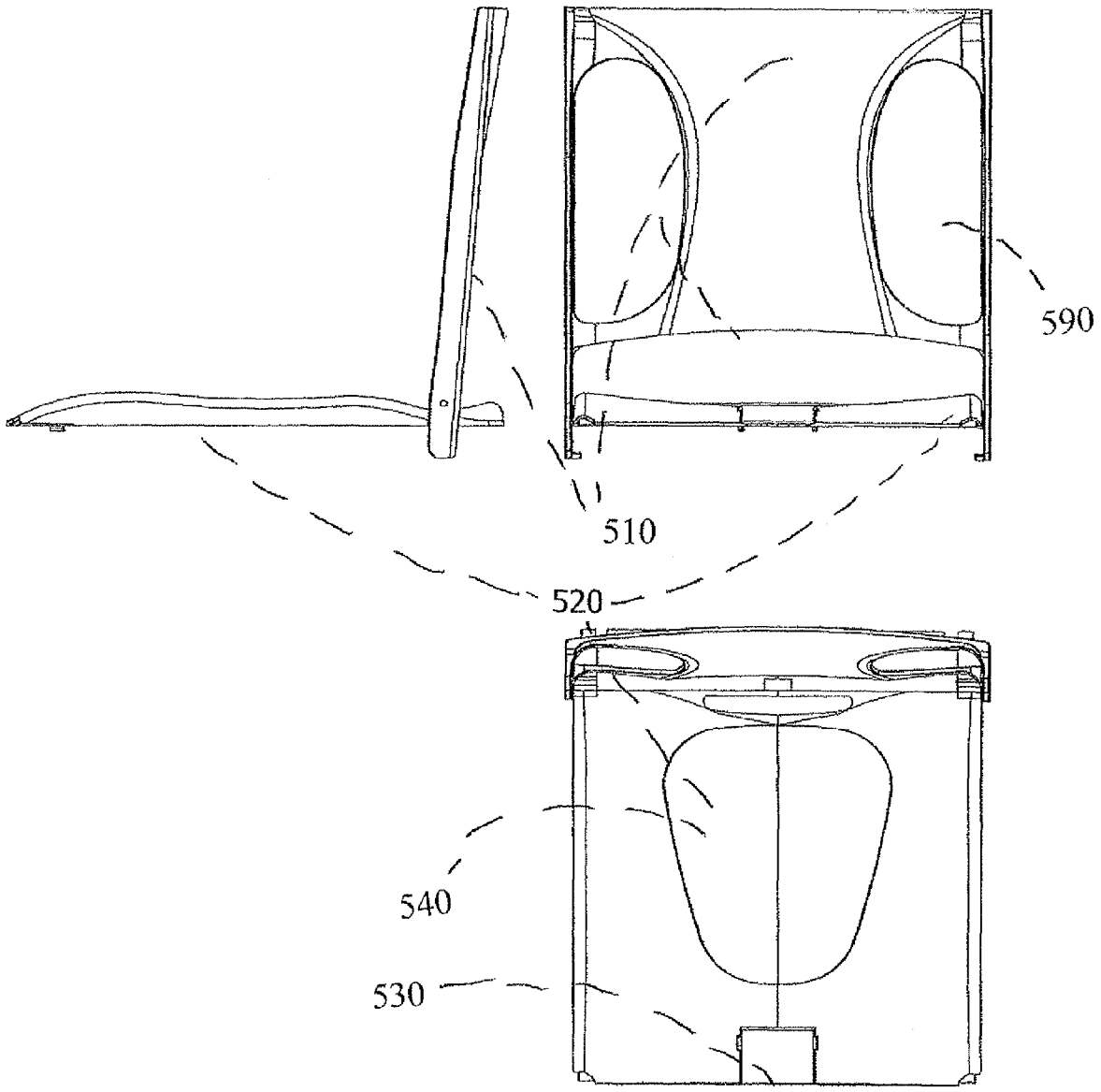

FIG. 6A: is a diagram of a SBC of an exemplary CW, from different angles, in accordance with some embodiments of the present invention.

Figure 6B:
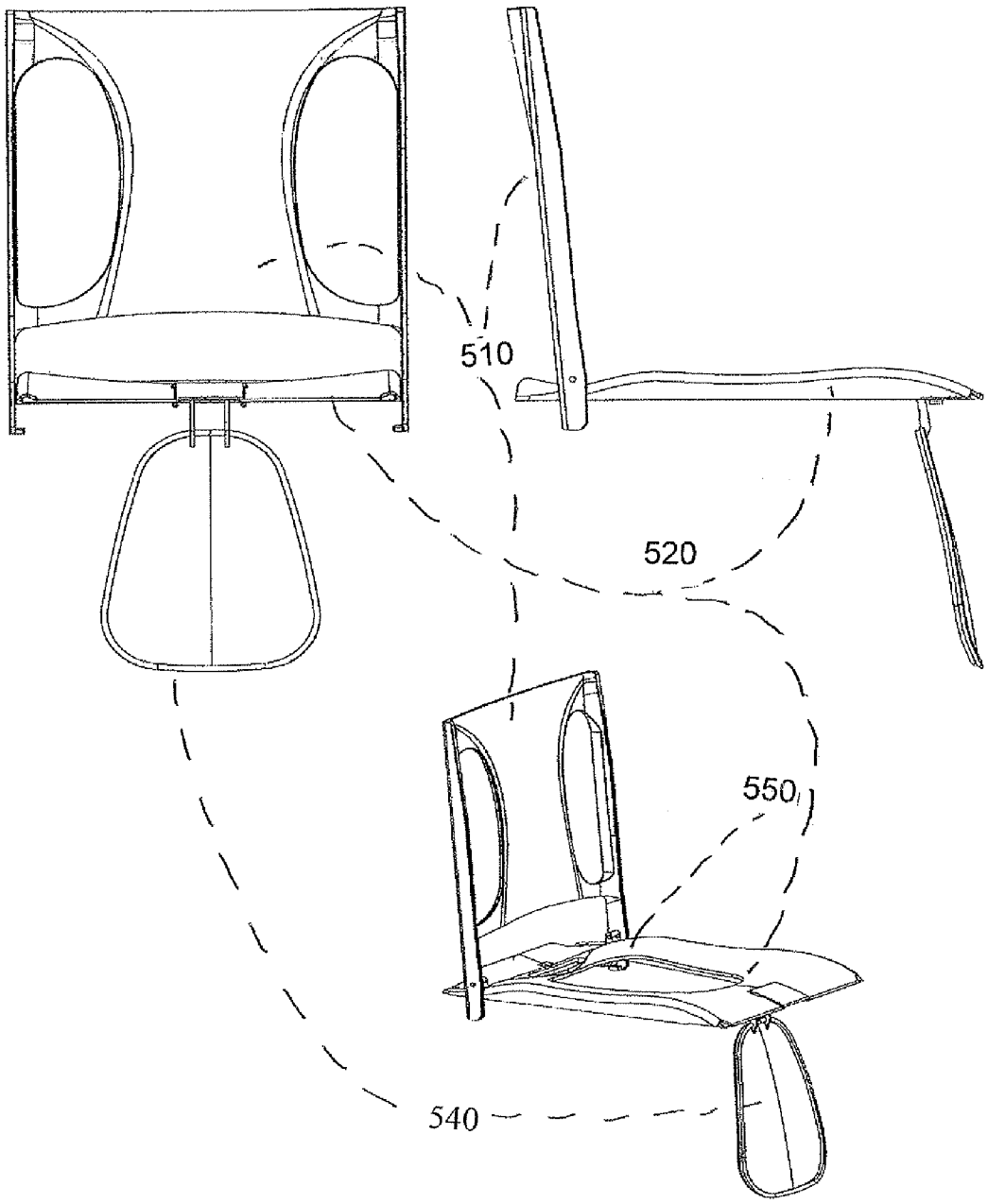

FIG. 6B: is a diagram of a SBC of an exemplary CW, with an open trap door, from different angles, in accordance with some embodiments of the present invention.

FIGS. 6C-6I: are diagrams of a SBC of an exemplary CW, in different stages of attachment/detachment from a chassis of an exemplary CW, including close-up details of the connections, all in accordance with some embodiments of the present invention.

Figure 6C:
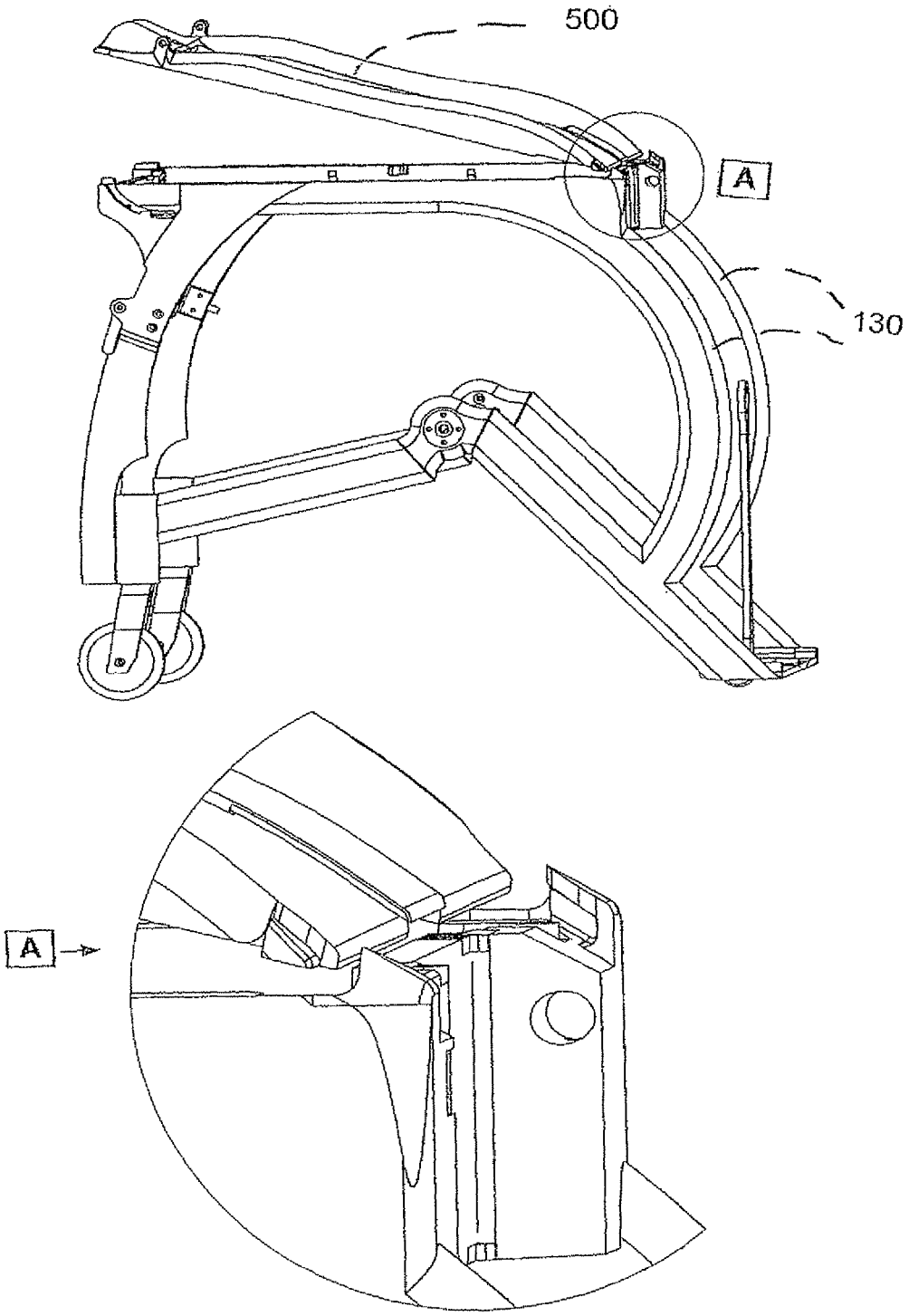
Figure 6D:
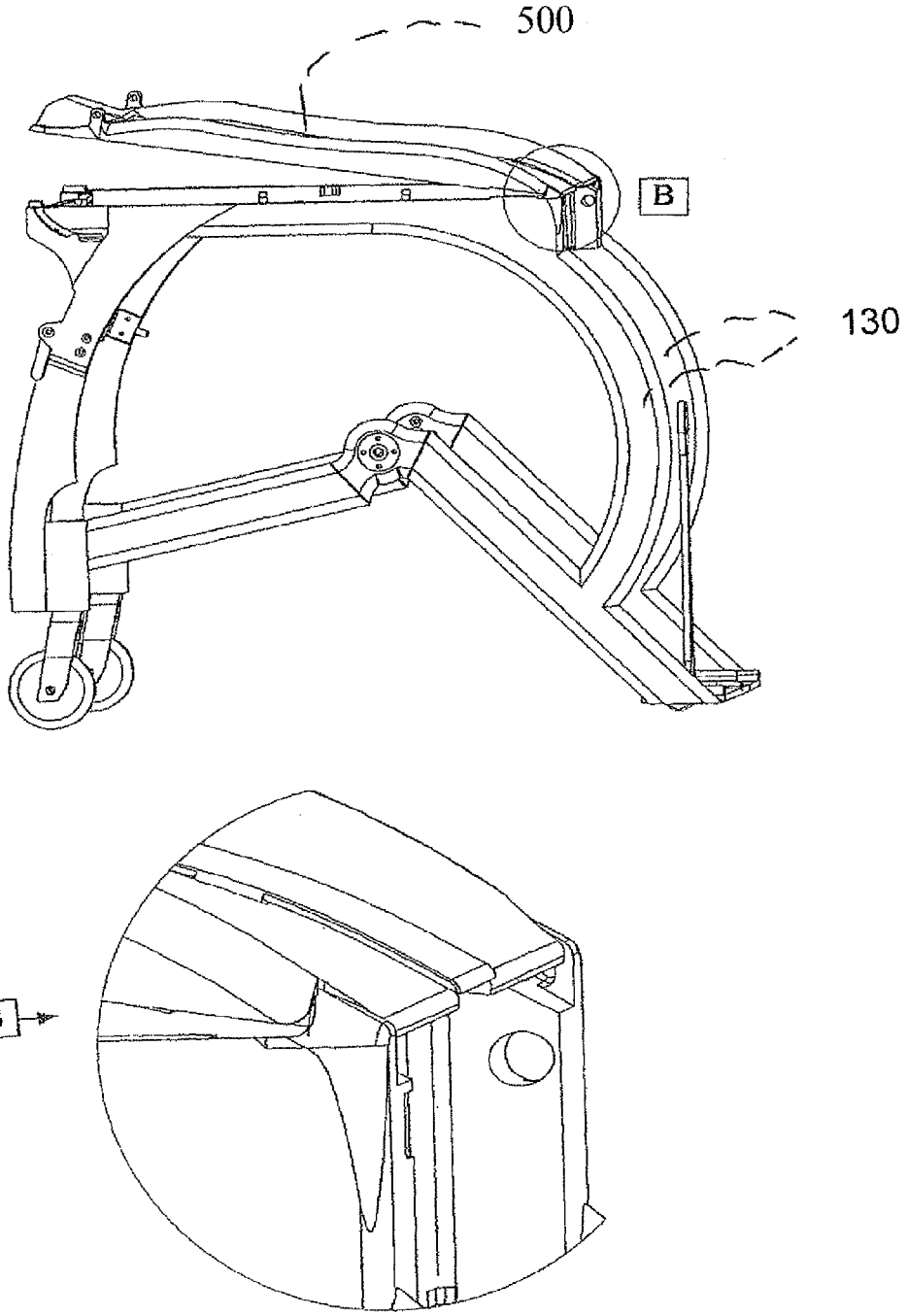
Figure 6G:
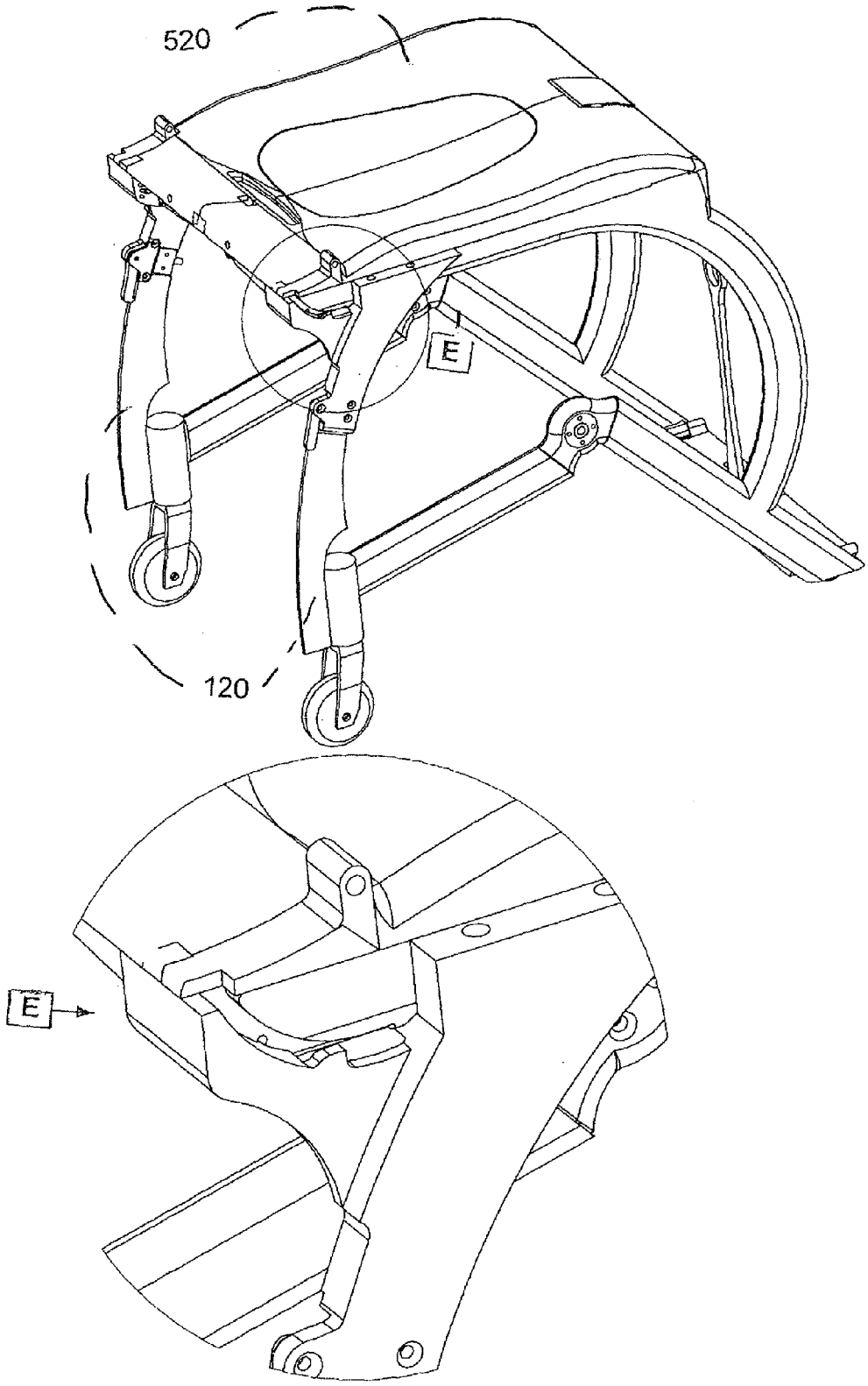
Figure 6H:
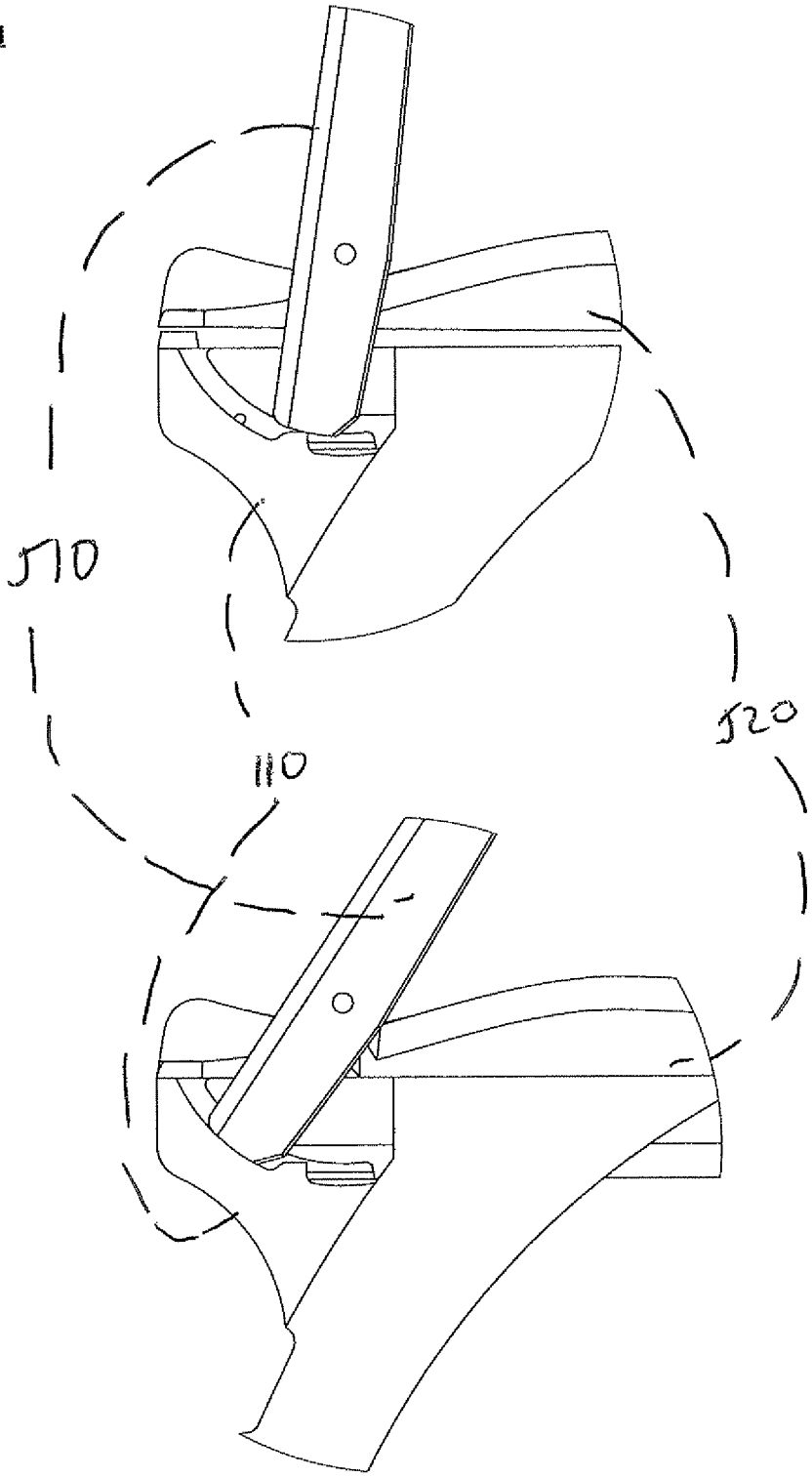
Figure 6I:
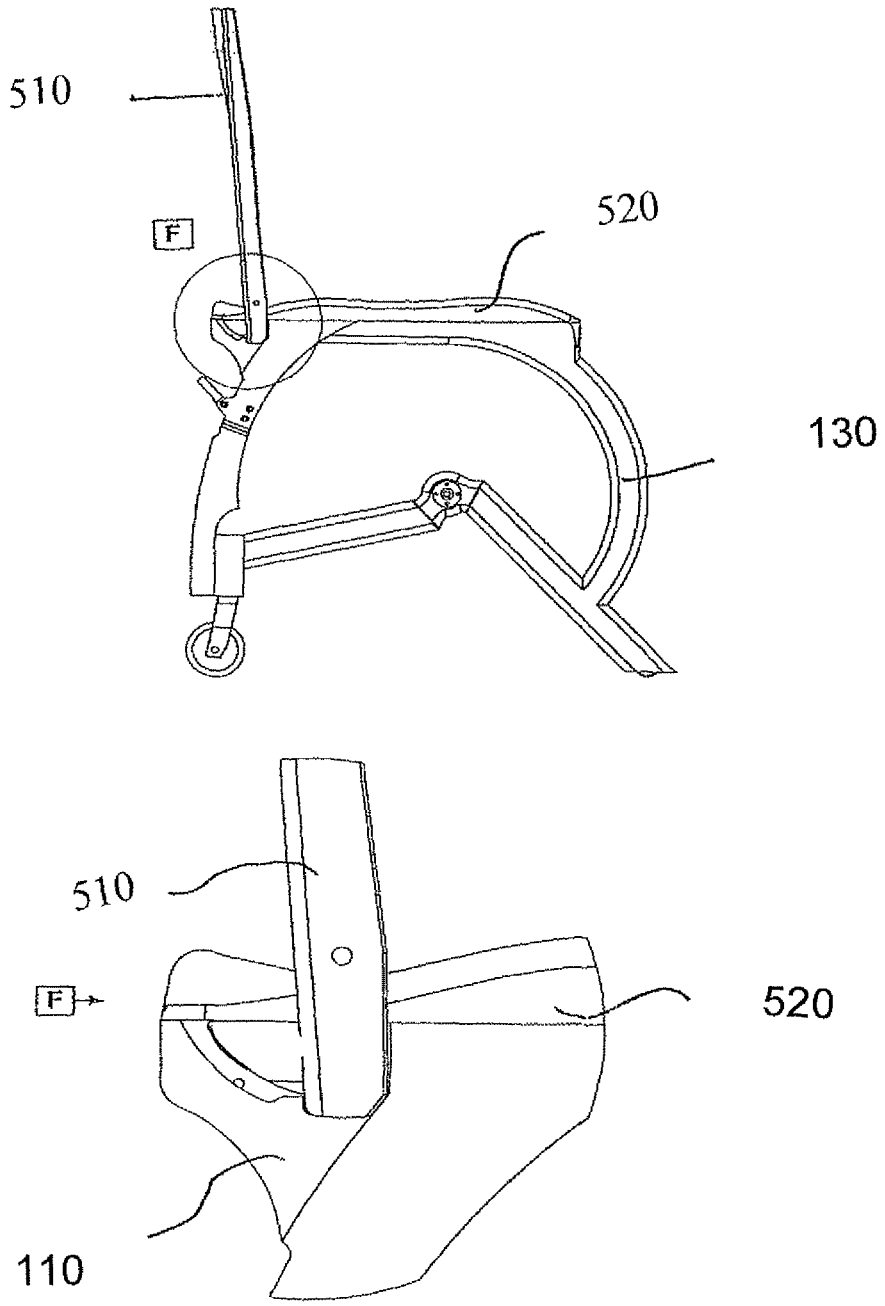
Figure 6J:
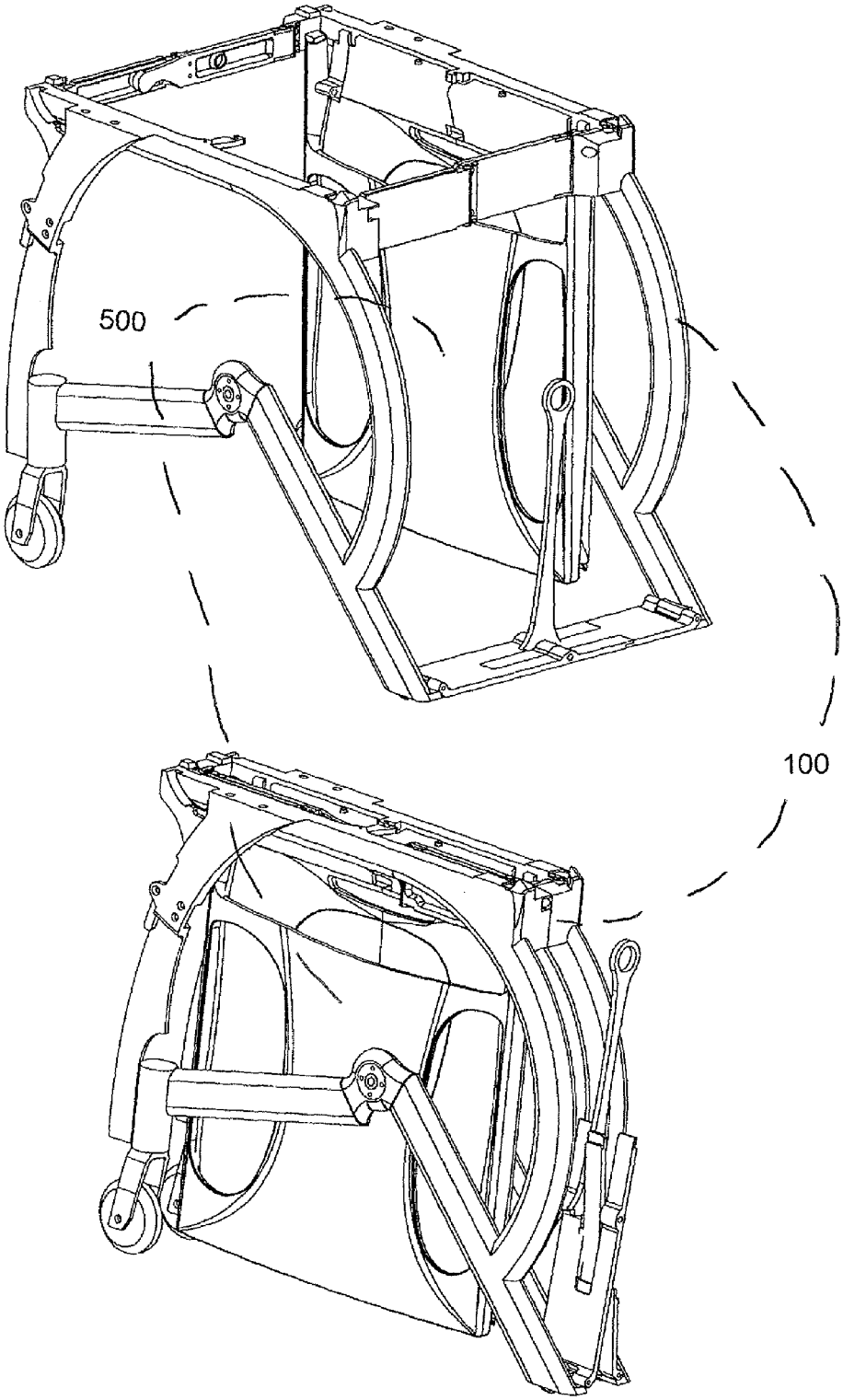

FIG. 6J: is a diagram of a SBC of an exemplary CW, stored within a chassis of an exemplary CW, open and collapsed, all in accordance with some embodiments of the present invention.

Figure 7A:
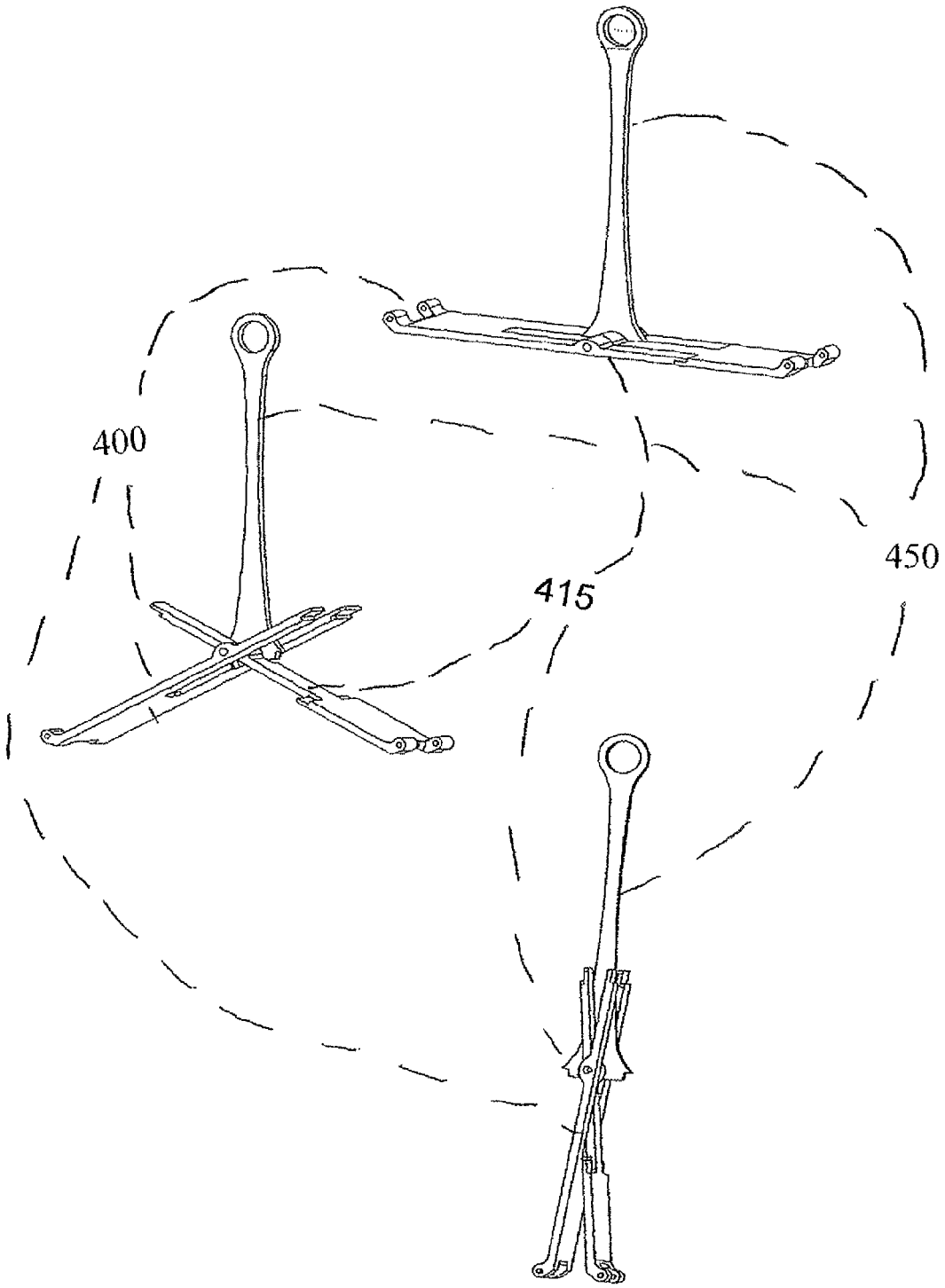

FIG. 7A: includes diagrams of a legrest of an exemplary CW, in different stages of folding, in accordance with some embodiments of the present invention.

FIG. 8A: is a diagram of front and rear wheels of an exemplary CW, including separate close-up details of the front and rear wheels and further including a detail of an embodiment of an exemplary CW without front wheels (marked with an *), all in accordance with some embodiments of the present invention.

Figure 9A:
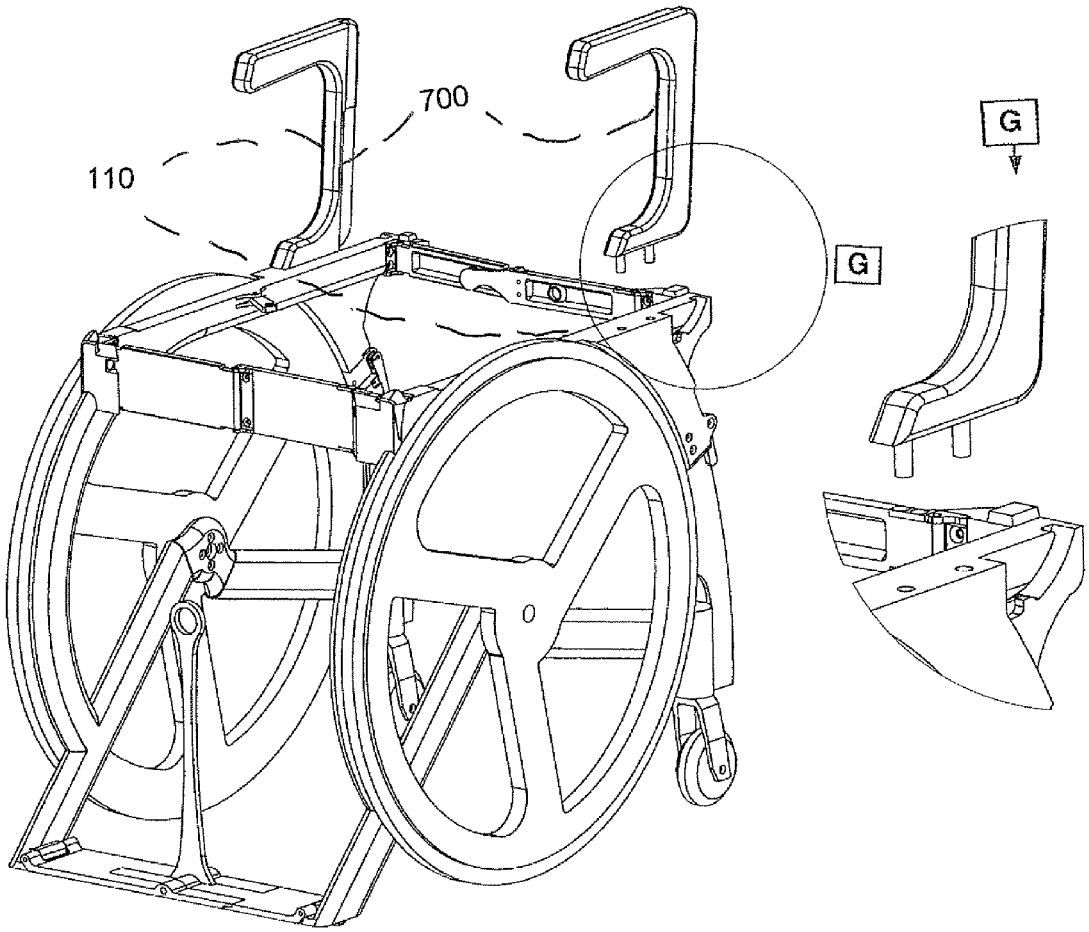
Figure 9B:
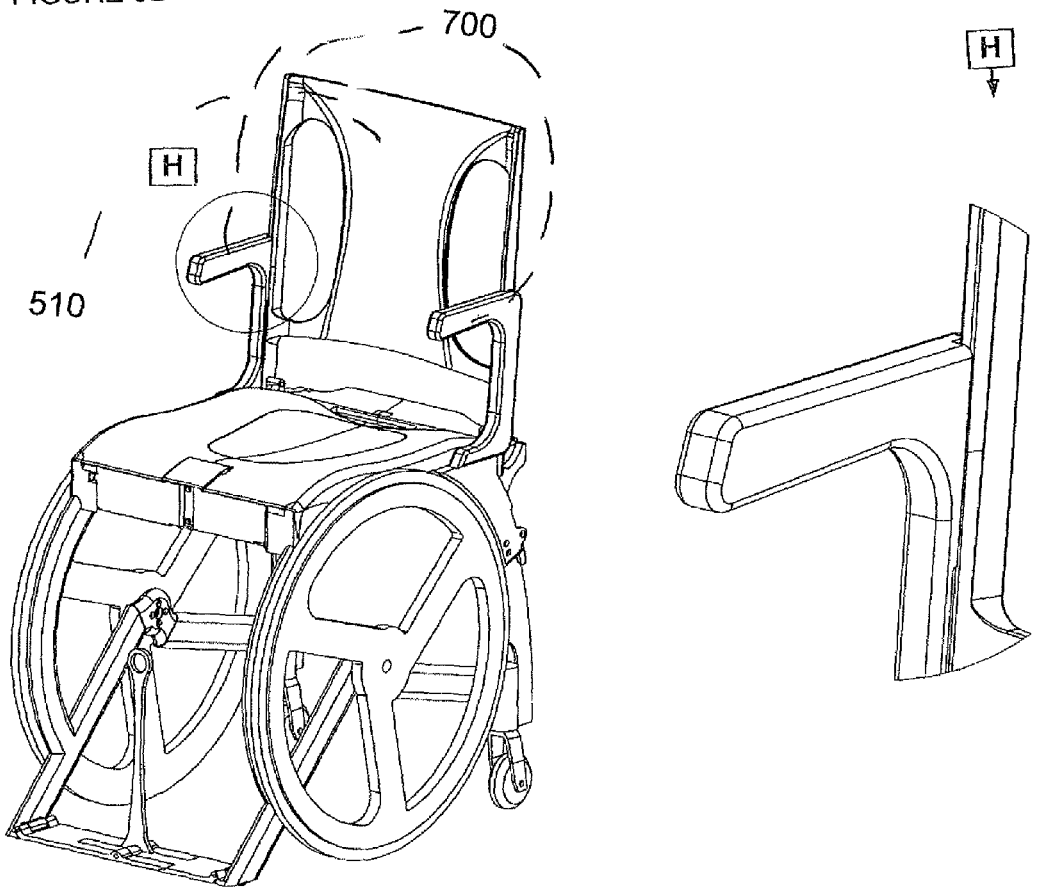

FIG. 9A-9B: are diagrams of an exemplary CW, including optional armrests attached, which diagrams include details of the connection of the armrests to the exemplary CW and of the relationship between the armrests and the backrest of the exemplary CW, all in accordance with some embodiments of the present invention.

Figure 10:
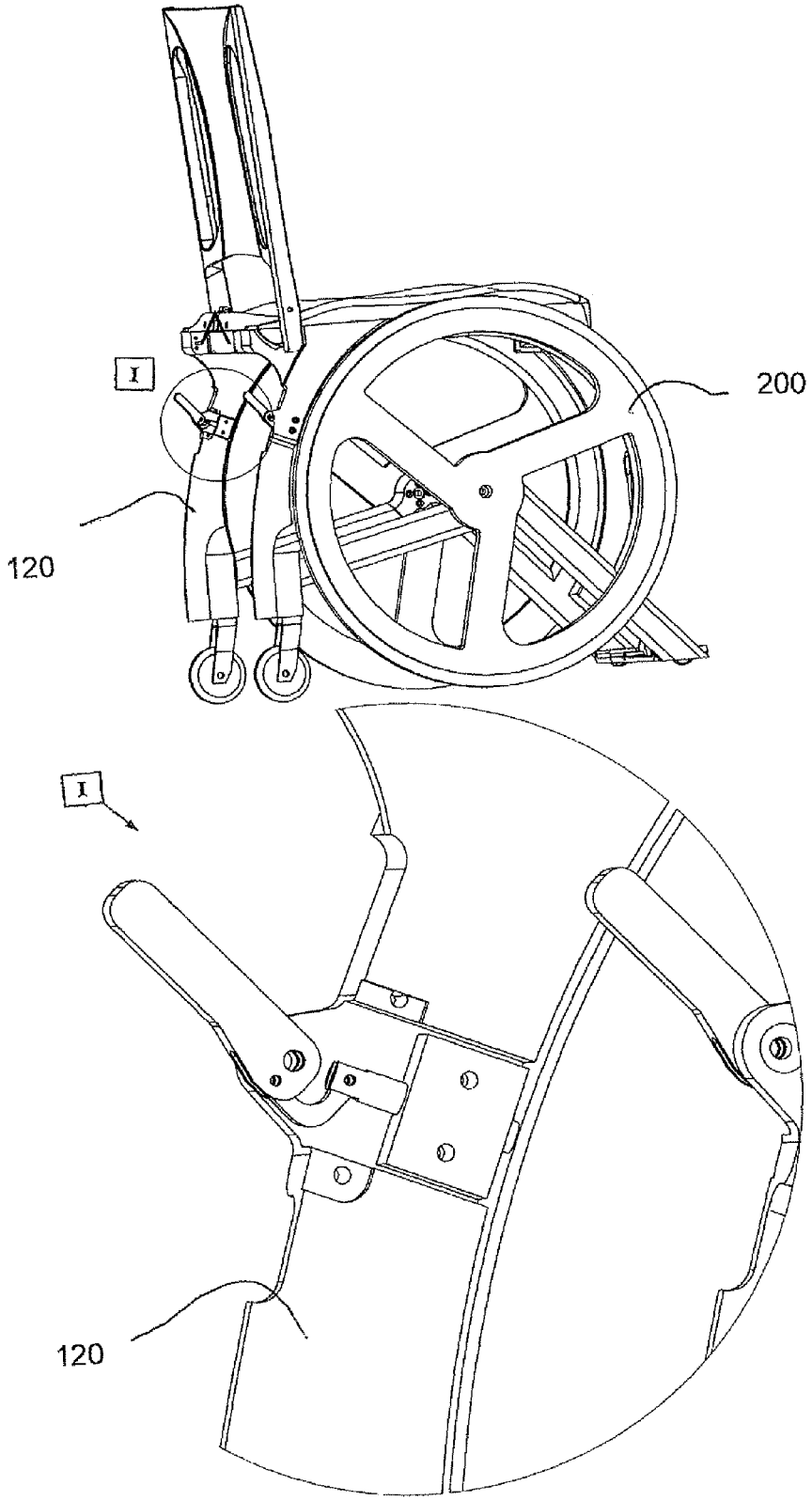

FIG. 10: is a diagram of an exemplary CW, including a close-up detail of a braking mechanism, in accordance with some embodiments of the present invention.

Figure 11:
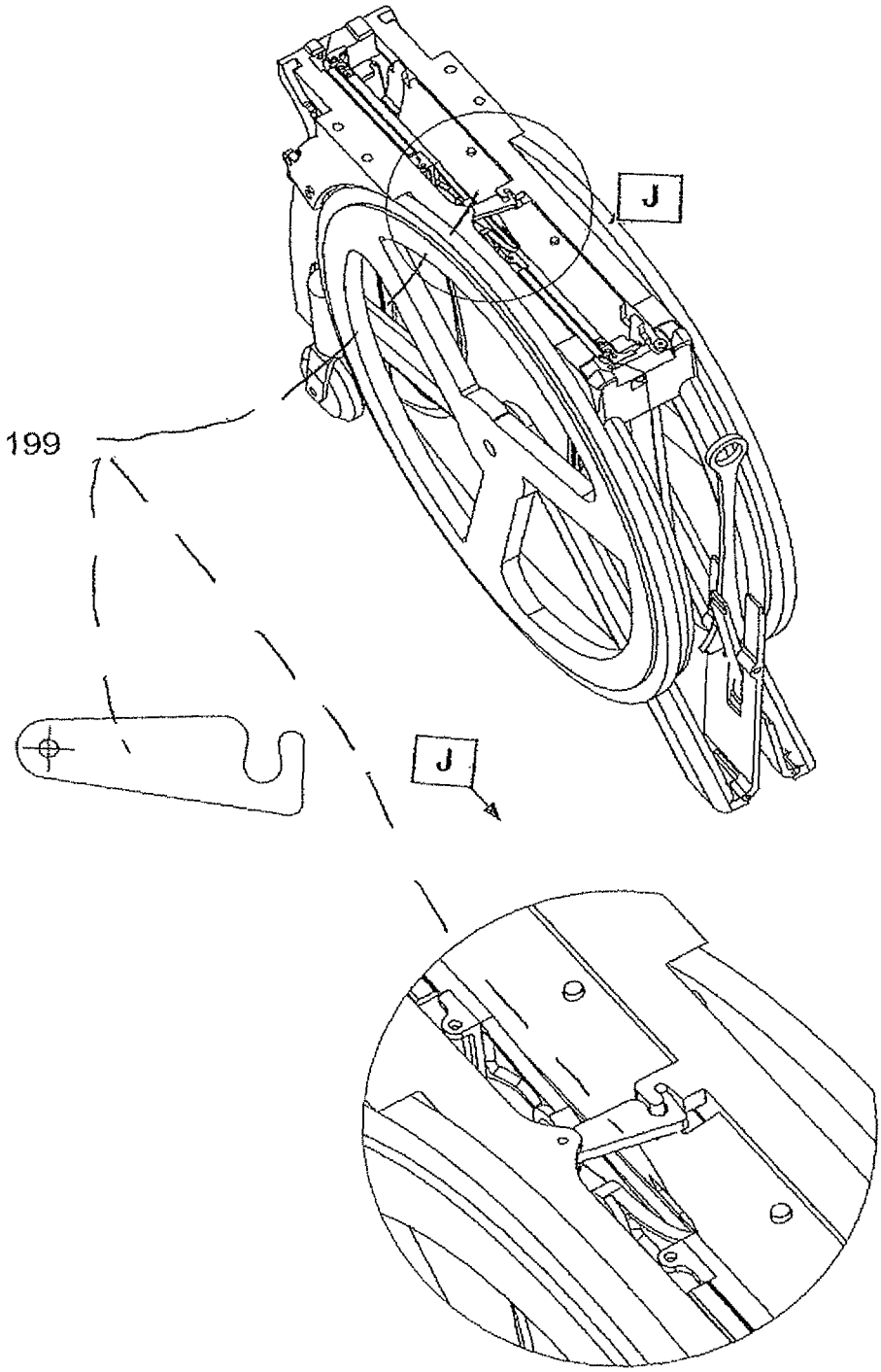

FIG. 11: is a diagram of an exemplary CW, collapsed, including close-up details of a clasp for locking the exemplary CW in its collapsed state, in accordance with some embodiments of the present invention.

Figure 12:
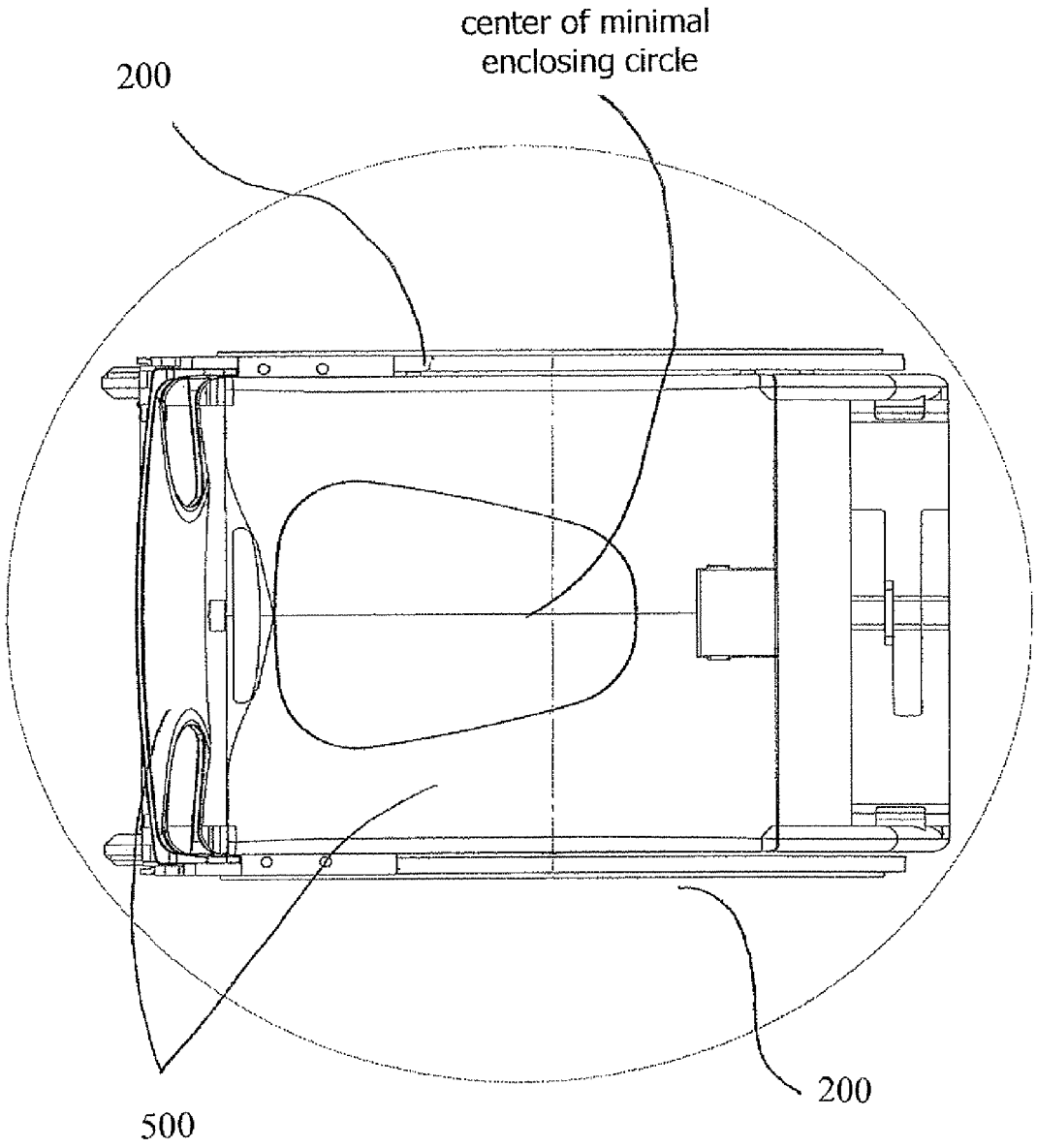

FIG. 12: is a diagram of an exemplary CW, showing the minimal enclosing circle of the exemplary CW, in accordance with some embodiments of the present invention.

Figure 13:
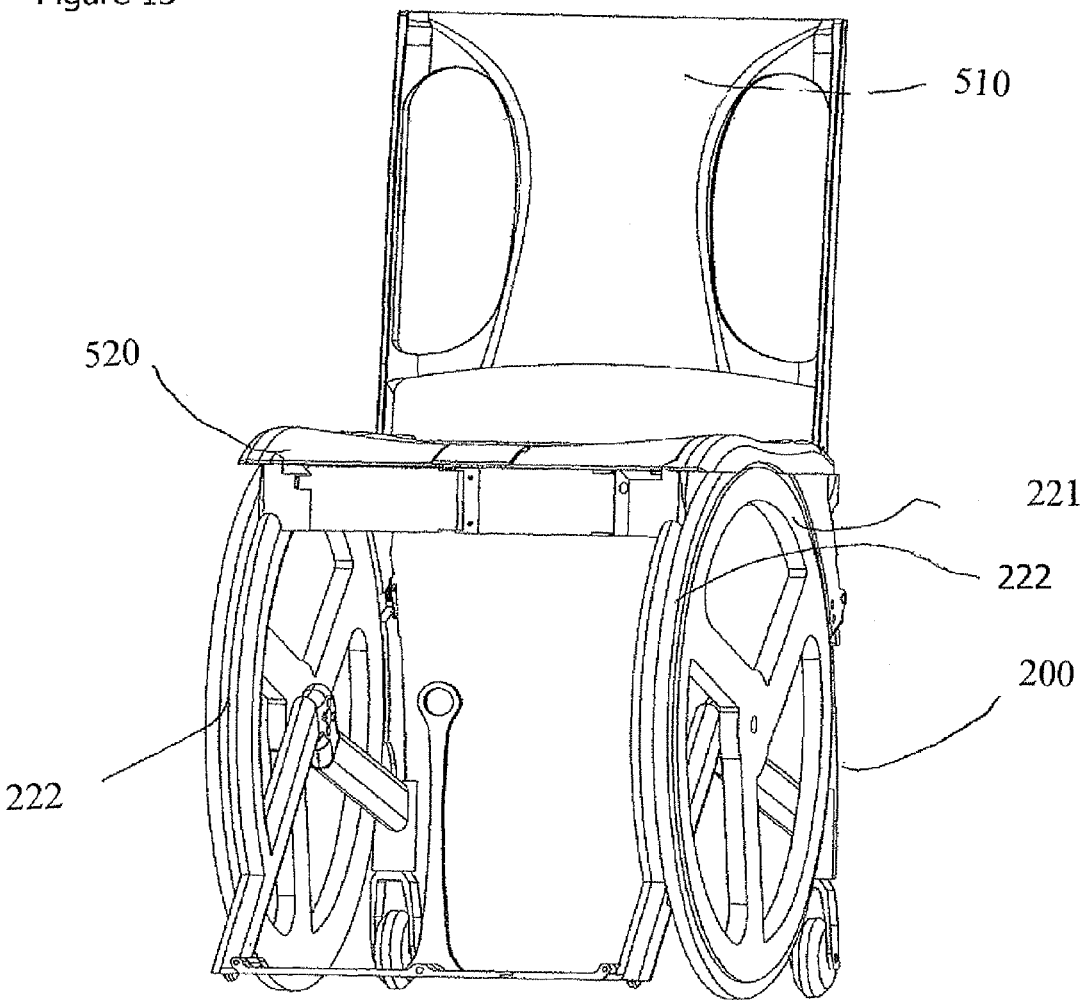

FIG. 13: is a diagram of a collapsible wheelchair, in accordance with one embodiment of the present invention, showing driving wheels situated beneath the seat, the driving wheels having large diameter rims and a tire, in accordance with one embodiment of the present invention.

Figure 13A:
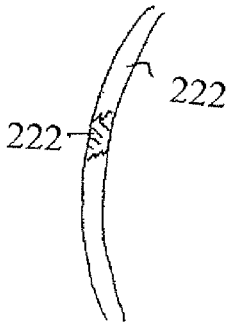

FIG. 13A: is a sketch of a rim of a driving wheel of FIG. 13 having a tire on it with a portion of the tire broken away to reveal the rim, in accordance with one embodiment of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

It should be understood that the accompanying drawings are presented solely to elucidate the following detailed description, are therefore, exemplary in nature and do not include all the possible permutations of the present invention.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, components and circuits have not been described in detail so as not to obscure the present invention.

In the following detailed description references to the figures appear in brackets. Numbers or letters appearing in brackets, e.g. [500], excluding paragraph numbers, should be understood to refer to elements marked within the figures by the same number or letter which appears in the brackets.

Figure 1A:
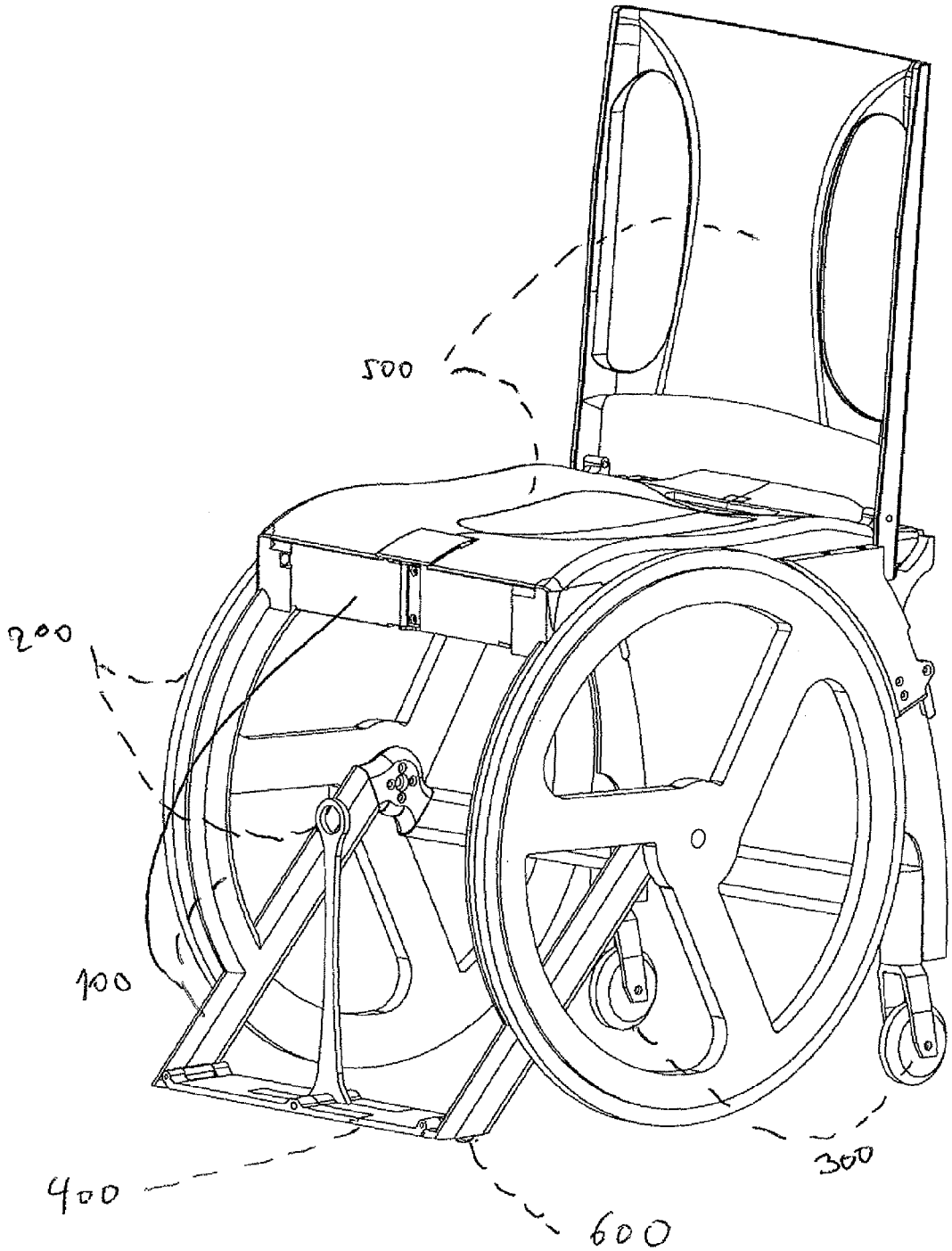
FIG. 1C: is a diagram of an exemplary CW, from a rear angle, demonstrating an unobstructed space in the rear of and underneath the exemplary CW, all in accordance with some embodiments of the present invention.
Figure 1B:
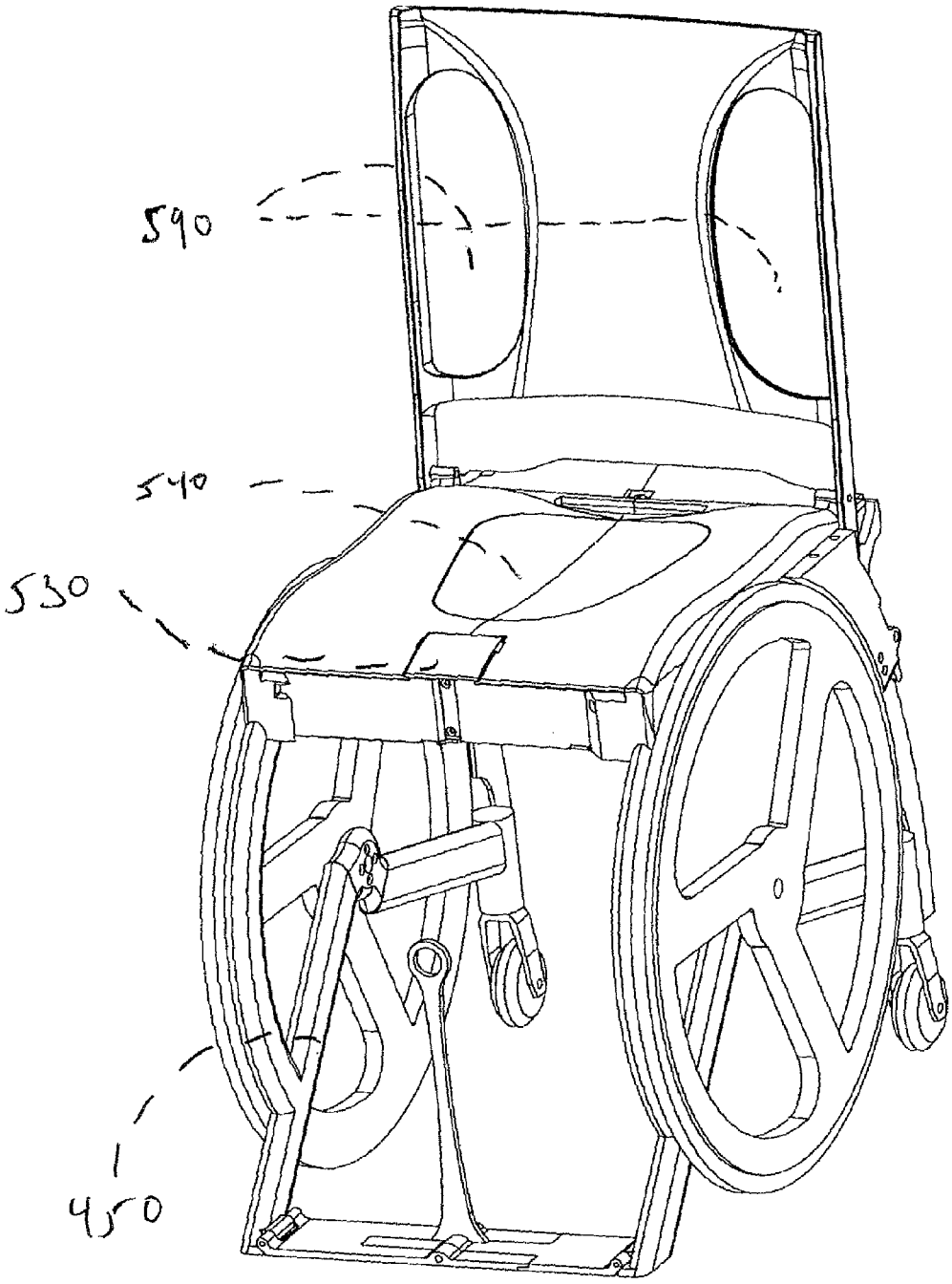
Figure 1C:
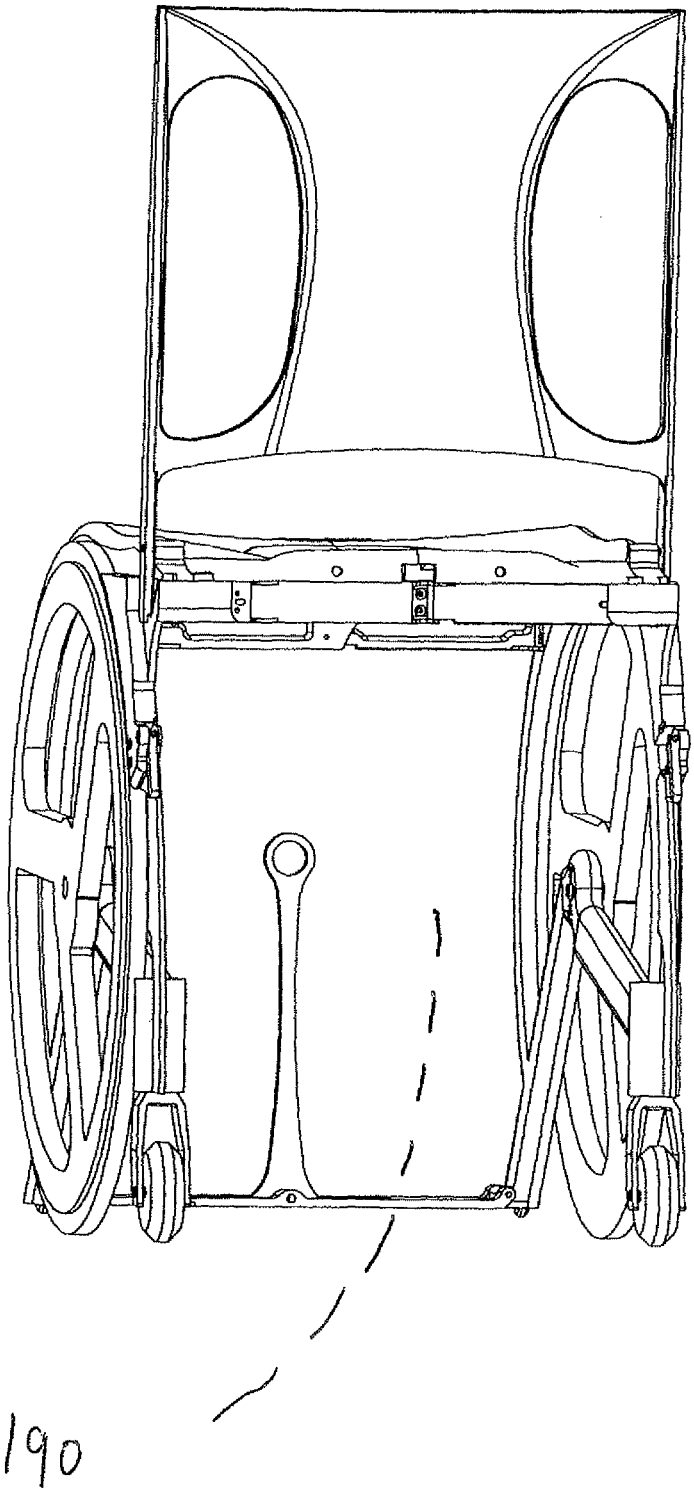
Figure 1D:
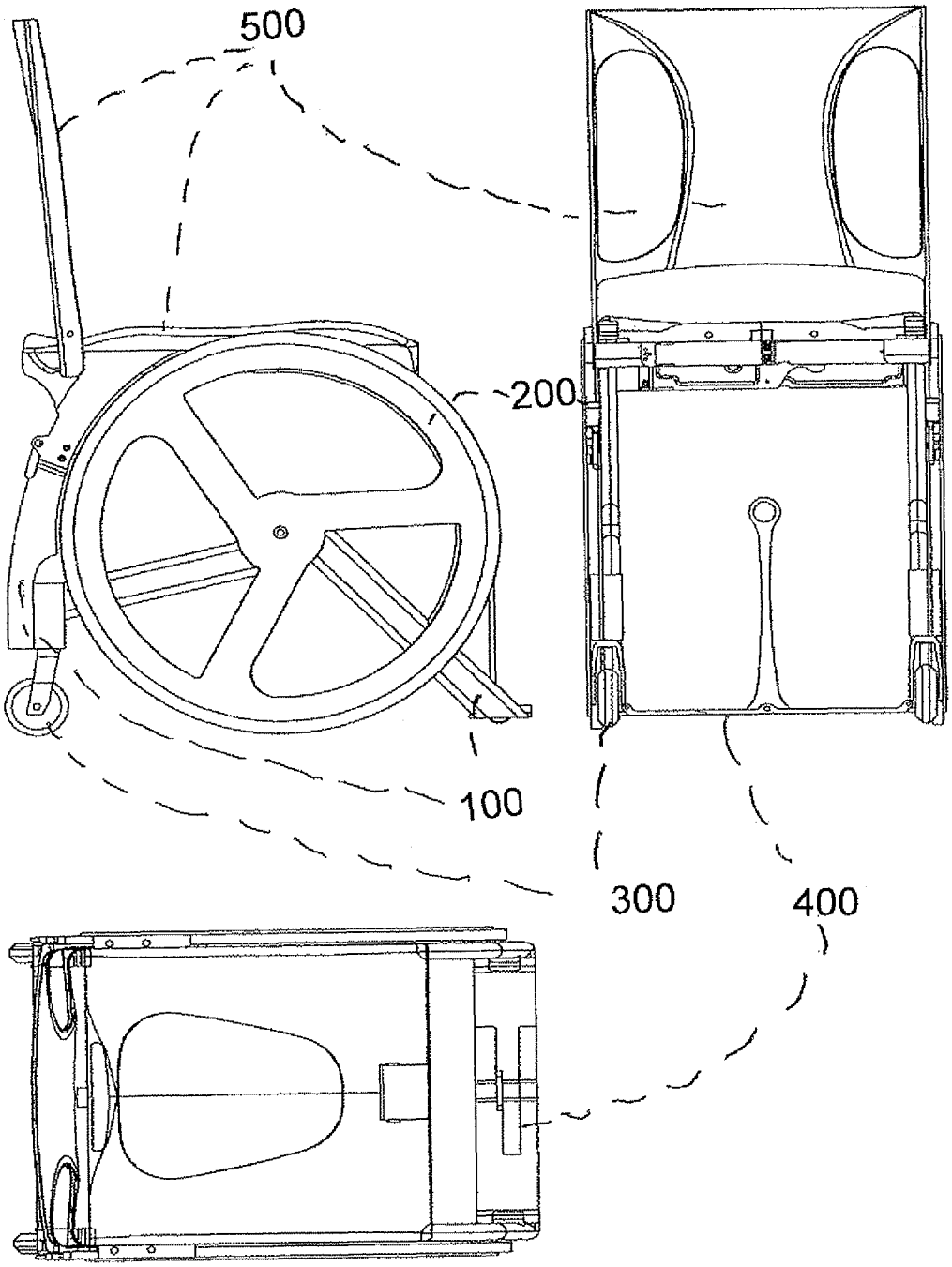

The present invention is a wheelchair. According to some embodiments of the present invention, there may be provided a wheelchair [see FIGS. 1A-1D] (hereinafter: "CW") which may be of small dimensions and lightweight, in relation to standard wheelchairs. According to further embodiments of the present invention, the CW may be adapted to be easily collapsed/folded into a cartable form [see FIG. 2L], allowing for easy storage, transport and use. According to yet further embodiments of the present invention, the CW may be adapted to be collapsed/folded and expanded/unfolded in a series of simple steps, executable with one hand, by a person in a seated position, allowing for independent use even by a user with limited physical capabilities. The CW may be of a small width in relation to standard wheelchairs, allowing for access into constricted spaces. Furthermore, the CW may be designed so that the spokes of its large wheels [230] can serve to drive and turn the CW, obviating the need for an exterior driving rim, thereby further reducing the width of the CW, yet at the same time allowing the CW to be driven by a user, seated on the CW, without the need for the assistance of another party. The CW may be designed such that the rear and interior space between its large wheels is unobstructed, leaving an unobstructed inner width [190] nearly the width of the CW [see FIG. 1C], allowing the CW to be maneuvered in reverse over standing objects, such as a standard toilet [see FIG. 3B]. Furthermore, the seat of the CW may be equipped with a trap door [540], to allow the use of a toilet while seated on the CW.

According to further embodiments of the present invention, the CW may be designed such that its large driving wheels are connected roughly at the center of each side of the CW [see FIG. ID], resulting in the center of the minimal enclosing circle of the CW being located roughly between the two large driving wheels [see FIG. 12], thereby giving the CW a very small turning radius, allowing for easy maneuvering in constricted spaces, such as a bathroom. Furthermore, as a result of such a design, the center of gravity, when a user is seated on the CW, may reside roughly underneath the seated user and between or behind the two large driving wheels, thereby, in combination with small rear and front wheels located before and after the large driving wheels, greatly reducing the probability of overturning the CW, forwards or backwards.

According to some embodiments of the present invention, The CW may be comprised of: (1) a chassis [100] comprised of multiple rigid bars connected by multiple joints adapted to facilitate the collapsing/folding of the CW; (2) two large driving wheels [200] which may be attached to the chassis approximately at its center [see FIG. 5B+C-#180]; (3) two small rear wheels [300] which may be attached to the rear of the chassis [see FIG. 8A]; (4) a legrest [400] which may be attached to both sides of the lower front portion of the chassis [see FIG. IA], may include a folding joint [FIG. 7A-#415] adapted to facilitate the collapsing/folding of the CW and may further include a handle [450] adapted to facilitate the folding of the legrest joint; (5) a detachable folding seat and backrest assembly/component [500] (hereinafter: "SBC") which may be adapted to be stored inside the chassis in its folded state [see FIG. 6J], adapted to connect to the top of the chassis in its open state [see FIGS. 6B-6H] and may include a trap door [540]; (6) two small wheels [600] attached to the bottom of the legrest; (7) detachable optional armrests [700]; and/or (8) miscellaneous connectors and other auxiliary parts.

Figure 4A:
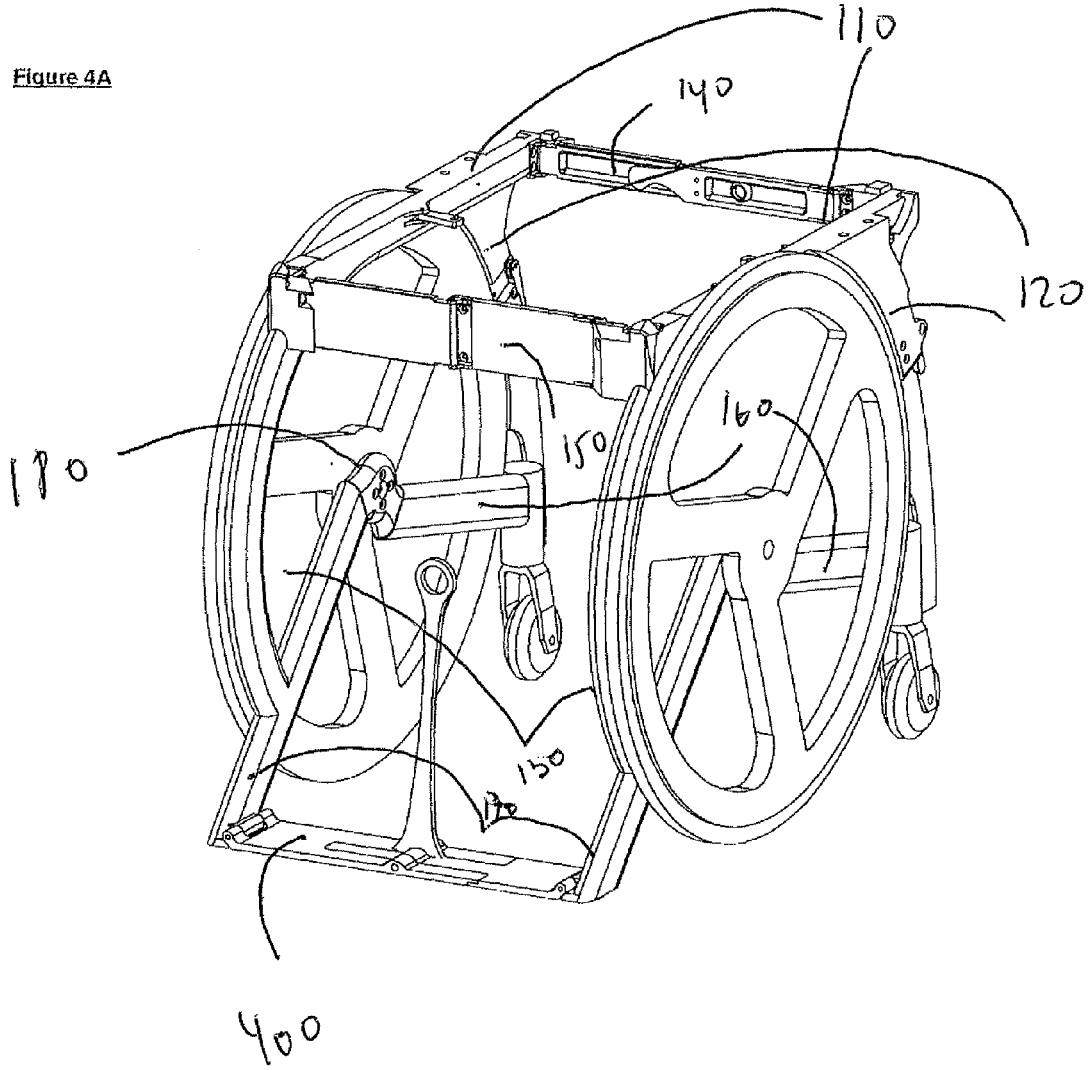
Figure 4B:
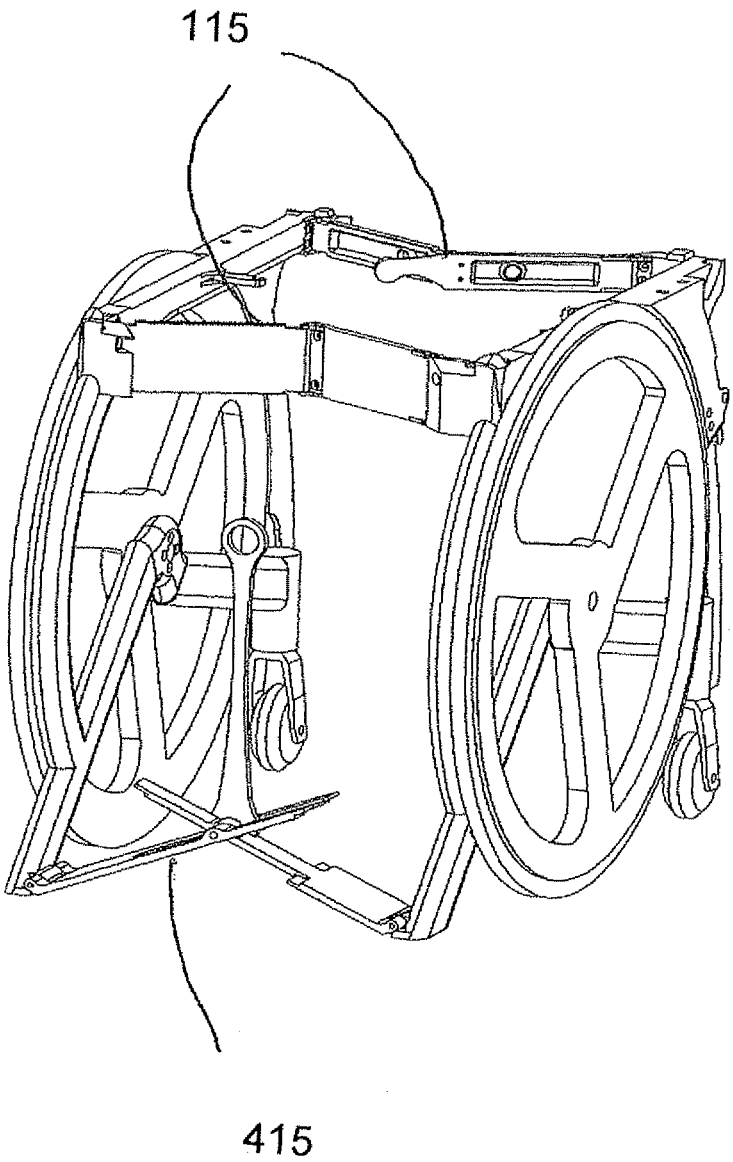
Figure 4D:
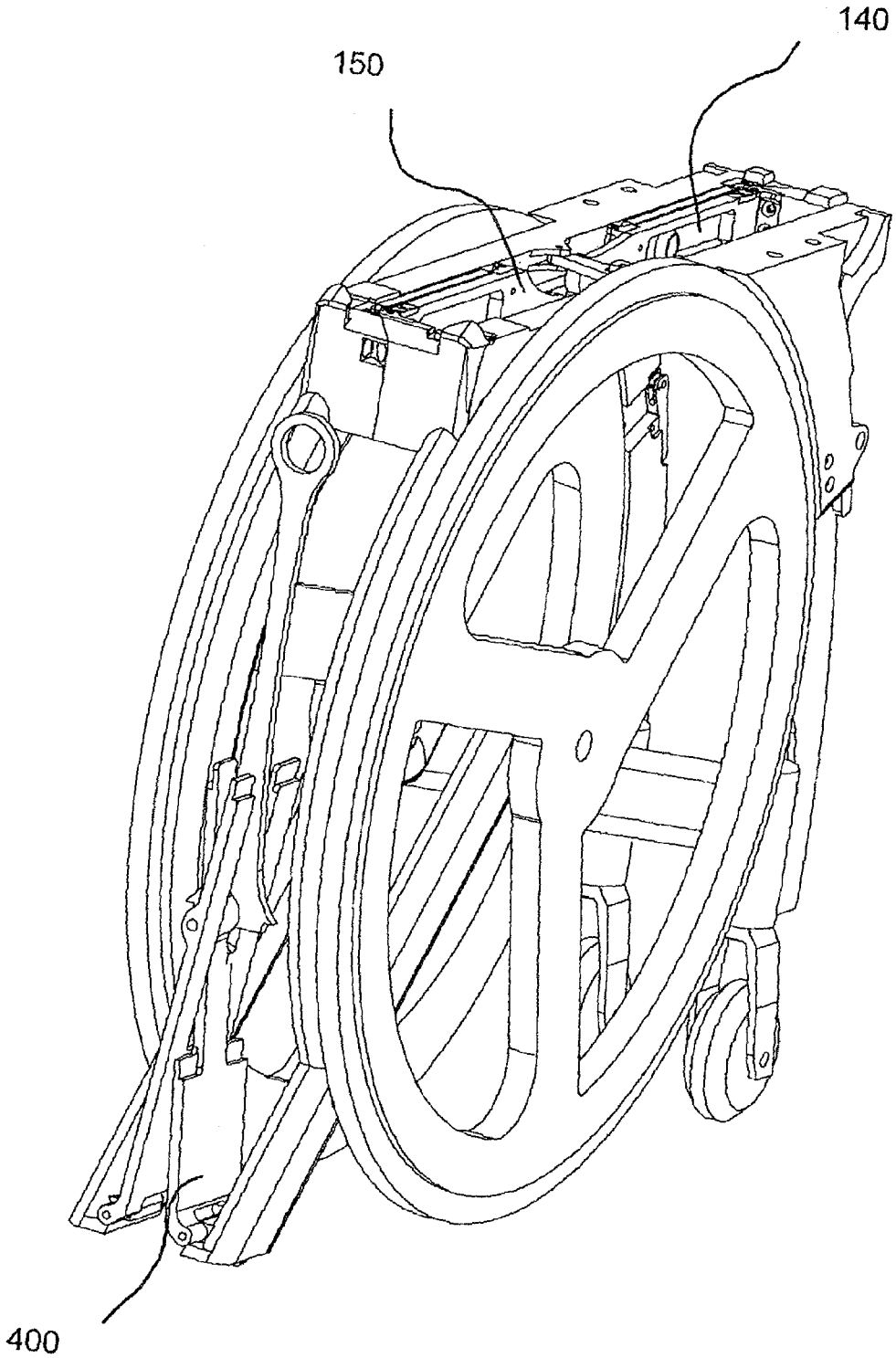

According to some embodiments of the present invention, the chassis [100] may be comprised of multiple rigid bars connected by a combination of rigid joints and folding joints, which form a flat squarelike form in its folded/collapsed state [see FIG. 4D] and a cubelike form in its open state [see FIG. 4A].

According to some embodiments of the present invention, the height and length of the chassis may be similar to the diameter of the large wheels, such that: (1) in its folded/collapsed state [see FIG. 4D] the resulting fiat squarelike form may roughly match the diameter of the large wheel in height and length; and (2) in its open state [see FIG. 4A], if connected to the large wheels roughly at the center of each side [180], the top of the chassis may be level or almost level with the top of the large wheel and the rear of the chassis may protrude only slightly behind the large wheels [see FIG. 4A]. As a result, in some embodiments of the present invention, the center of the minimal enclosing circle of the CW may be located roughly between the two large driving wheels [see FIG. 12], thereby giving the CW a very small turning radius. Furthermore, as a result of such a design, the center of gravity, when a user is seated on the CW in its open state, may reside roughly underneath the seated user and between or behind the two large driving wheels (roughly in the center of the chassis), thus, in combination with the small rear and front wheels, greatly reducing the probability of overturning the CW, forwards or backwards.

According to further embodiments of the present invention, the bars which comprise the chassis may be arranged to avoid obstructing functionality of the CW. For example, all the horizontal bars included in the chassis which run along the width of the CW [see FIG. 1C] may be situated at the top of the chassis, such that the space between the sides of the chassis [190] is unobstructed below the top of the chassis from the rear up to the front of the chassis, where the legrest is situated. This may allow the CW, in its open state, to be wheeled backwards to stand over a standing object [see FIG. 3B] (e.g. a toilet), as long as the object is shorter than the top of the chassis. Furthermore, the bars comprising the sides of the chassis may follow the contour of the upper portion of the large driving wheels [see FIG. 5*b*], such that there are no chassis components located in the space inside the upper portion of the large driving wheels [166], allowing a user of the CW to insert his/her hands inside the upper portion of the large driving wheels without obstruction or fear of "catching/pinching" the hand [see FIG. 5C].

According to some embodiments of the present invention, the side portions of the chassis may be arranged so that the outer rims of the large driving wheels contact the chassis in multiple locations [see FIG. 5C-5E] along the circumference of the large driving wheels, such that the large wheels provide structural support to the chassis, such as lateral support, and vice versa. According to further embodiments of the present invention, the chassis may further include an intermediary material (e.g. rubber pads) or bearings connected to the chassis at those locations where the large wheels contact the chassis.

According to some embodiments of the present invention, the chassis may be comprised of:

a. Two top side horizontal bars [110], which may be flat on the top surface and curved on the bottom surface to match the contour of the top of the large driving wheels, when these are connected to the frame [see FIGS. 5B-5E];

b. Two rear vertical bars [120], each connected, by a rigid joint/connector, to one of the top side horizontal bars towards the rear of the horizontal bar. According to further embodiments of the present invention, the rear vertical bars may be curved and/or may have a curved inner surface [see FIG. 5D] to match the contour of the rear of the large driving wheels, when these are connected to the frame. The rear vertical bars may be roughly equal in width to the width of the large wheels, such that they do not protrude outside the width of the CW nor inside the inner side of the large wheels, thus avoiding increasing the width of the CW while not obstructing the inner space of the CW;

c. Two front vertical bars [130], each connected, by a rigid joint/connector, to one of the top side horizontal bars towards the front or at the front of the top side horizontal bar. According to further embodiments of the present invention, the front vertical bars may be curved and/or may have a curved inner surface [see FIG. 5D] to match the contour of the front of the large driving wheels, when these are connected to the frame;

d. A rear horizontal bar [140], which may be comprised of 2 bars [see FIG. 4A+4C] connected to each other at the center of the rear horizontal bar by a folding joint [115], and connected at each side to the rear or towards the rear of one of the two top side horizontal bars [see FIG. 4A+4C], also by folding joints, such that the rear of the chassis is comprised of two vertical bars separated by a folding horizontal bar located at the height of the top of the rear vertical bars. As a result, in such embodiments, the space between the rear vertical bars [190] may be unobstructed below the rear horizontal bar;

e. A front horizontal bar [150], which may be comprised of 2 bars [see FIG. 4A-4C] connected to each other at the center of the front horizontal bar by a folding joint [775], and connected at each side at the front or towards the front of each of the two top side horizontal bars, also by folding joints [see FIG. 4A+4C];

f. Two side rear lower horizontal bars [160], each connected to the lower portion of one of the rear vertical bars [120] and running, possibly at a slightly upward angle, approximately to the center of the side of the frame [180], where the hub of the large driving wheels connects to the frame [see FIG. 5B]; and/or g. Two side front lower horizontal bars [170], each running from the center of the side of the frame [180], where the hub of the large driving wheels connects to the frame, possibly at a downward angle, to the lower front portion of the CW, where the legrest is to be located [see FIG. 4A]. The front vertical bars may be connected to the front lower horizontal bars midway or towards the end of the bars, above the location where the legrest is to be located [see FIG. 4A].

The bars comprising the chassis may be fabricated from a rigid material, such as titanium, aluminum, fiberglass, carbon fiber, other reinforced plastics, any other appropriate material and/or any combination thereof. According to some further embodiments of the present invention, one or more of the bars comprising the chassis may be fabricated as one piece, instead of two bars connected by a rigid joint. For example, the side front lower bars and the front vertical bars may be fabricated as one piece. Conversely, one or more of the chassis components may be fabricated from two or more pieces connected or attached to each other.

According to some embodiments of the present invention, the large driving wheels may be comprised of: (1) a hub [210], which may connect to the chassis roughly at the center of the side of the chassis [180] and may include bearings to facilitate the rotation of the wheels; (2) an outer rim [220], which may contact the chassis in multiple locations [see FIGS. 5D-5E], providing support to the chassis and receiving support from the chassis; and (3) spokes [230] connecting the outer rim to the hub, which spokes may be designed to be comfortably gripped by a human and as such to be used as driving handles, i.e. used to push the CW forward or backward by a user. The large driving wheels may be fabricated from titanium, aluminum, fiberglass, carbon fiber, other reinforced plastics, rubber, any other appropriate material and/or any combination thereof.

According to some embodiments of the present invention, the rear wheels [300] may be significantly smaller than the large wheels and may be connected to the rear vertical bars directly below the rear vertical bars [see FIG. 8A]. The rear wheels may be fabricated from rubber, titanium, aluminum, fiberglass, carbon fiber, other reinforced plastics, any other appropriate material and/or any combination thereof.

Figure 2A:
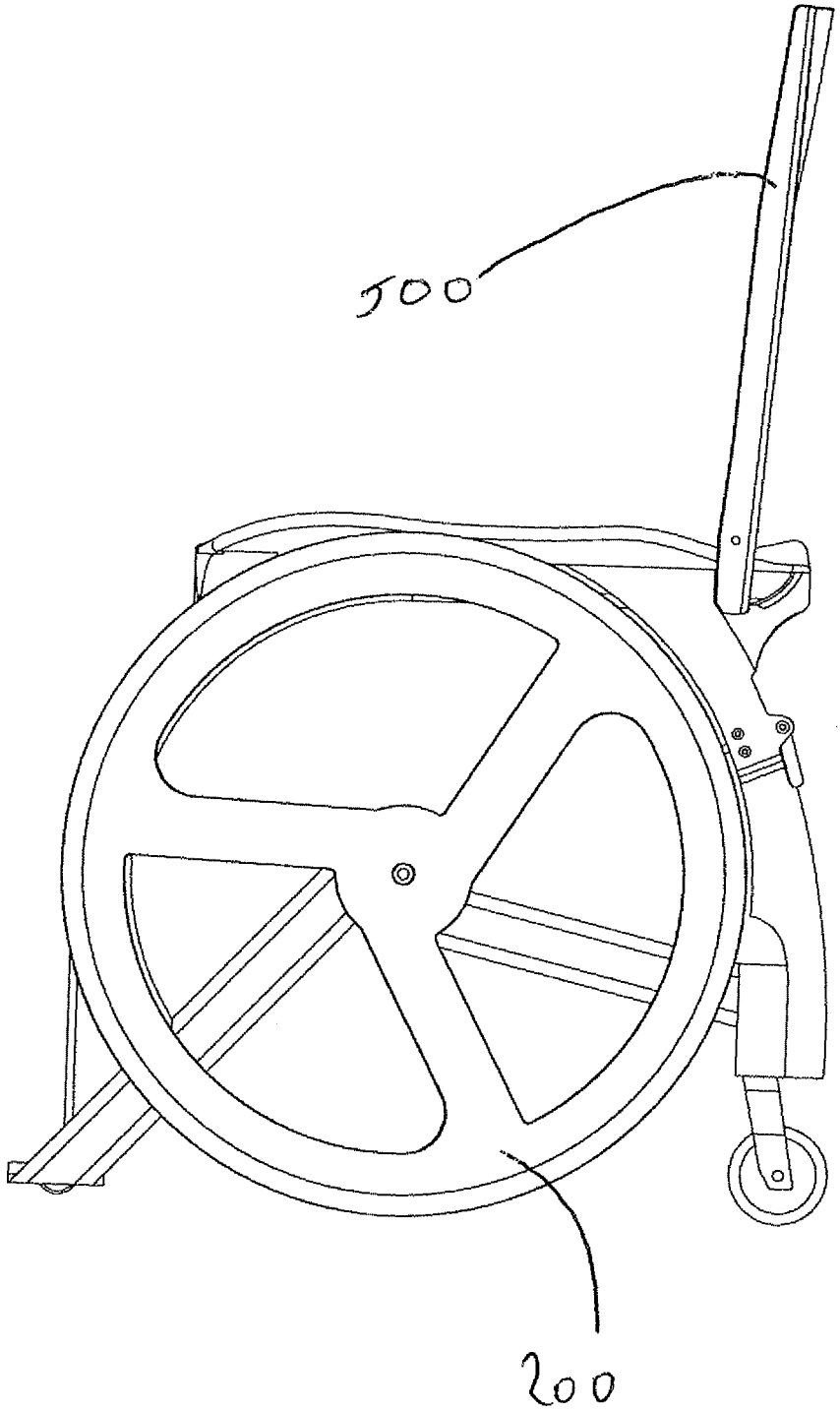
Figure 2B:
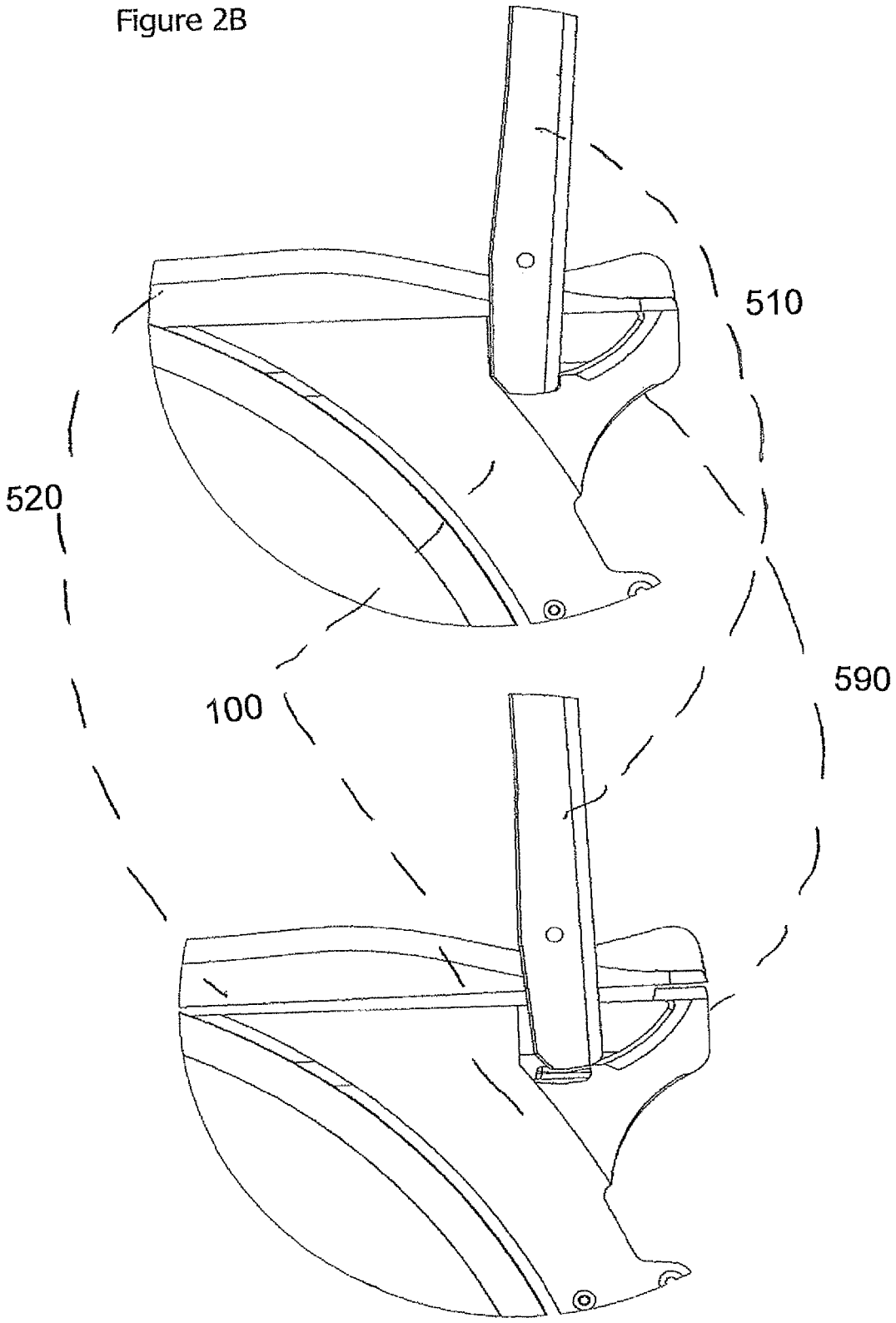
Figure 2C:
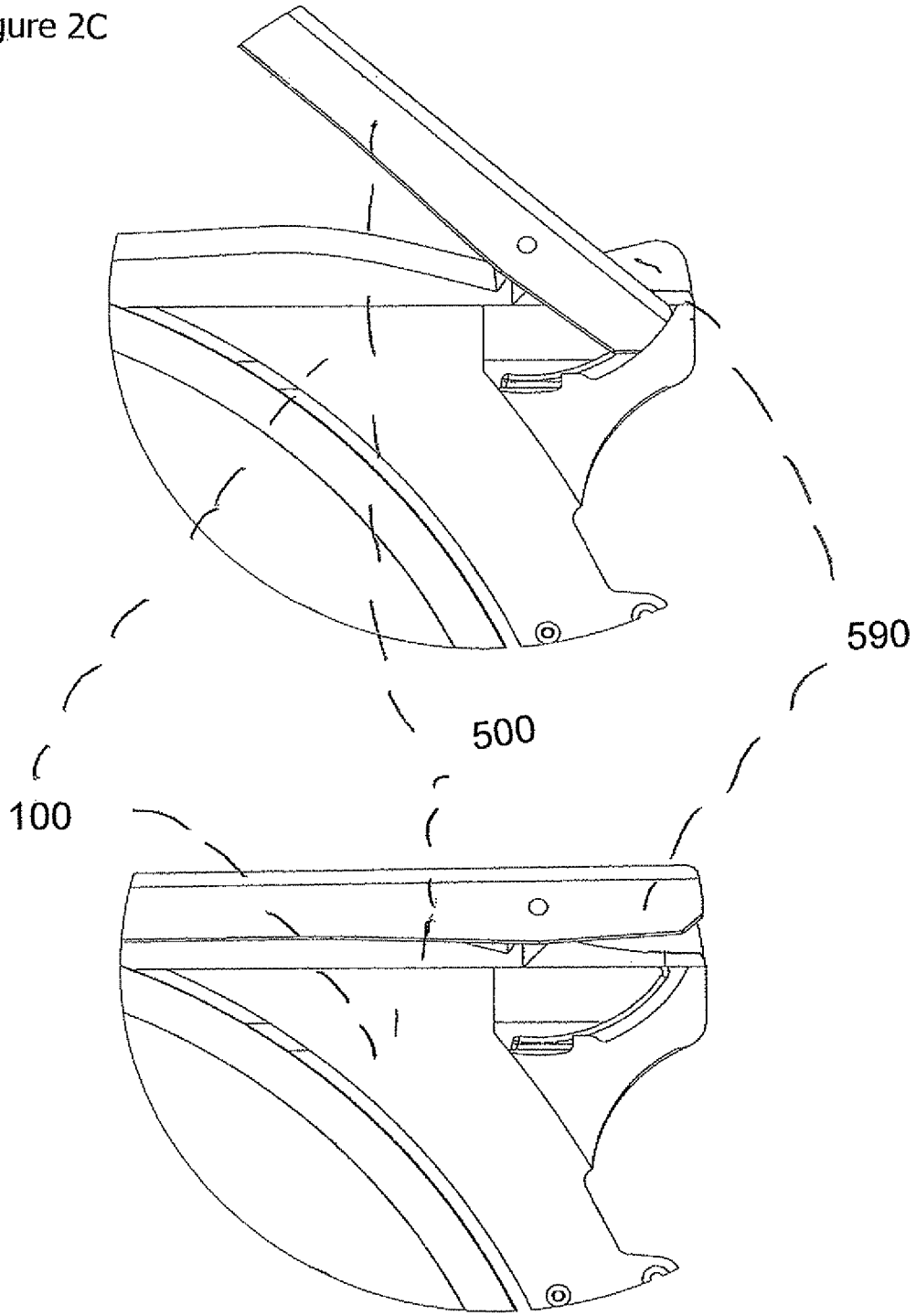
Figure 2D:
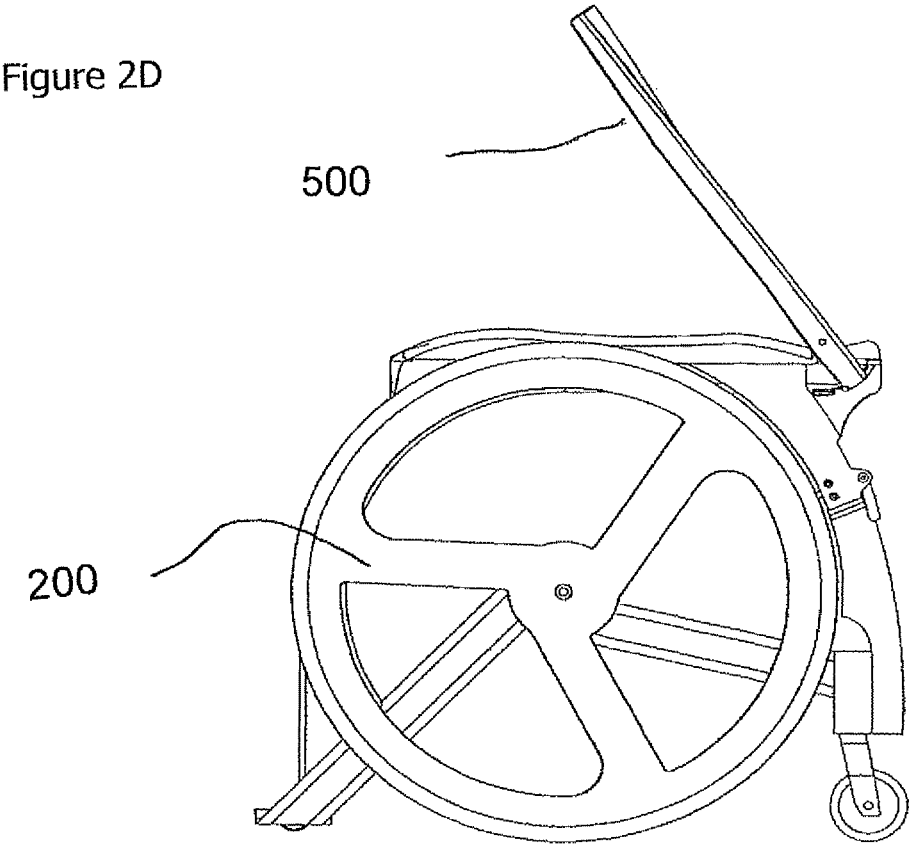
Figure 2E:
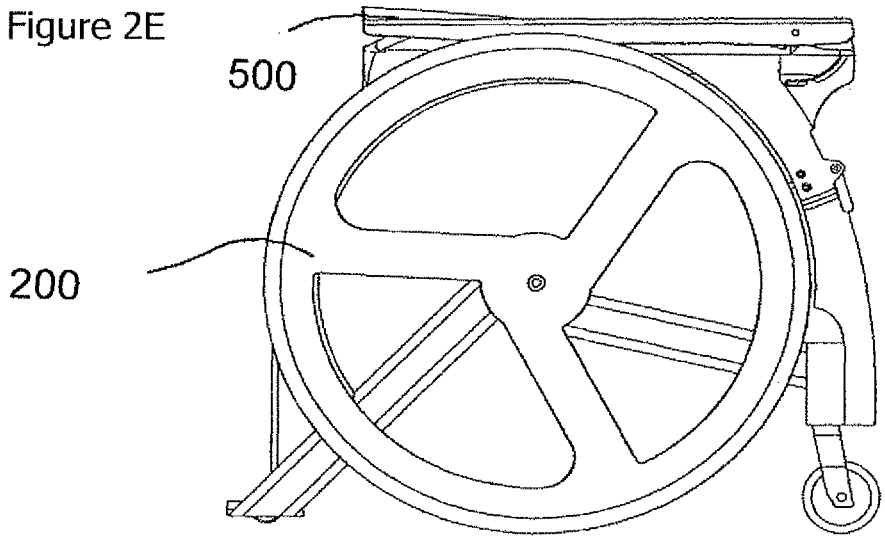
Figure 2H:
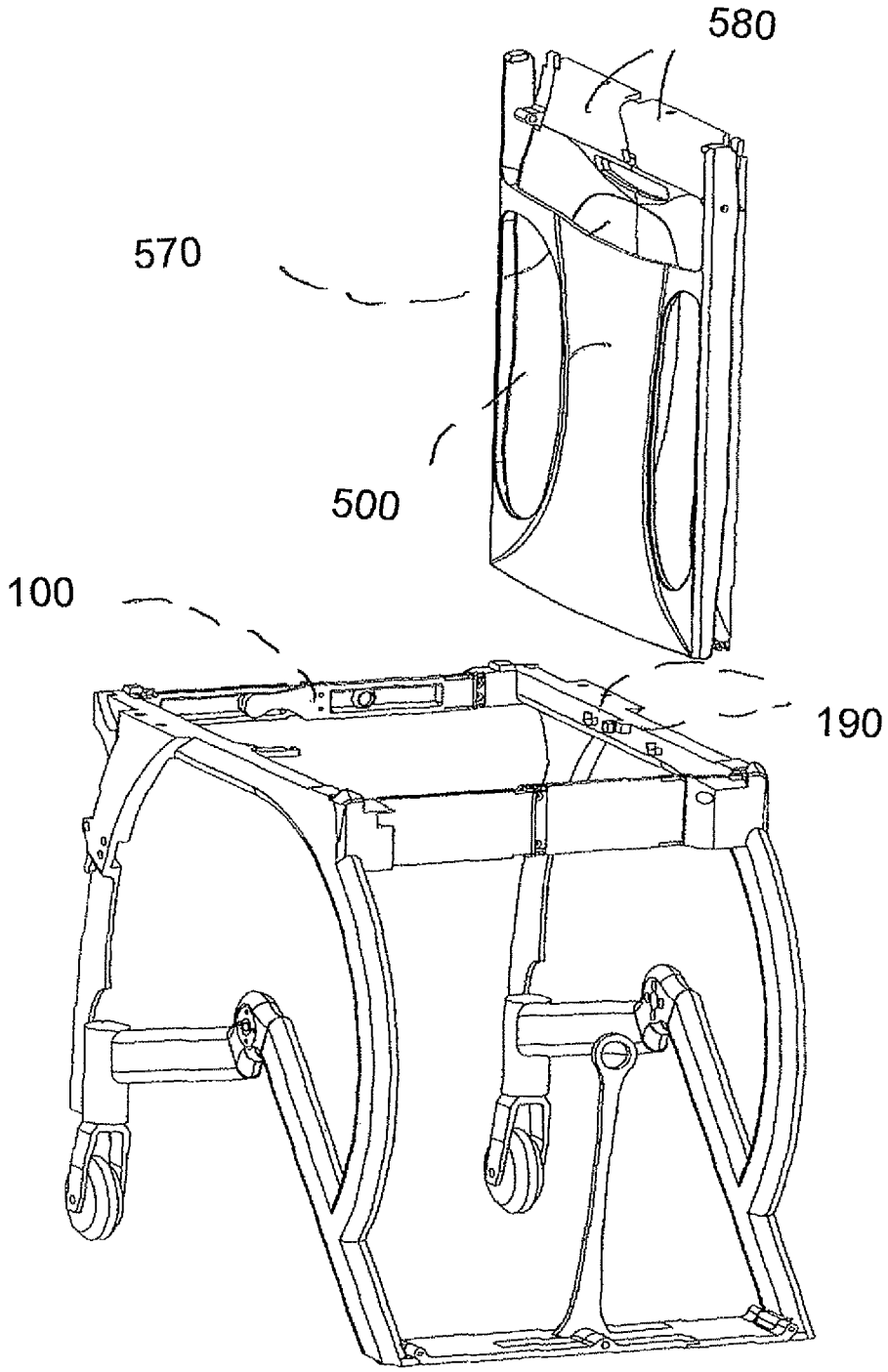
Figures 2I, 2J:
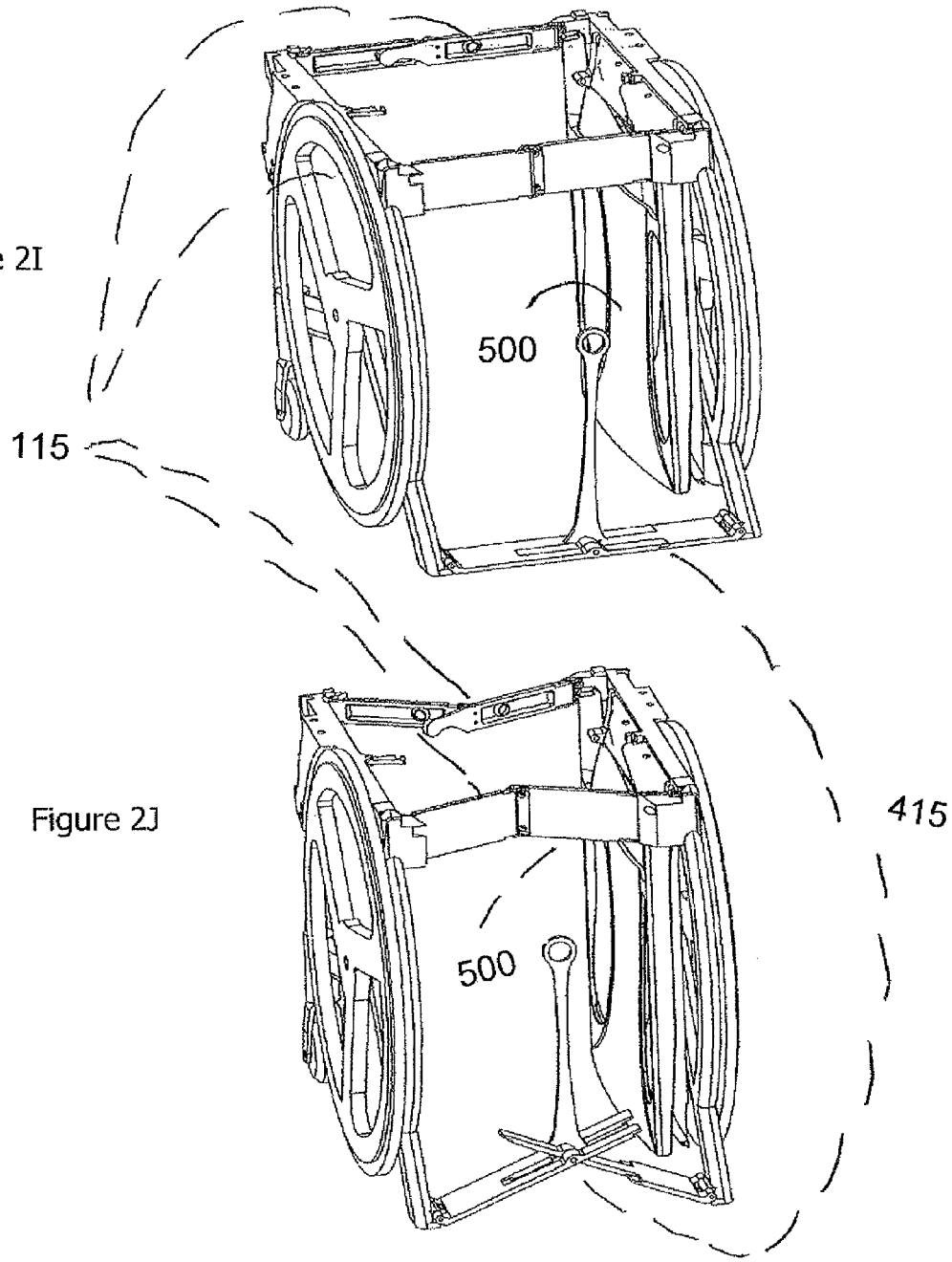
Figure 2K:
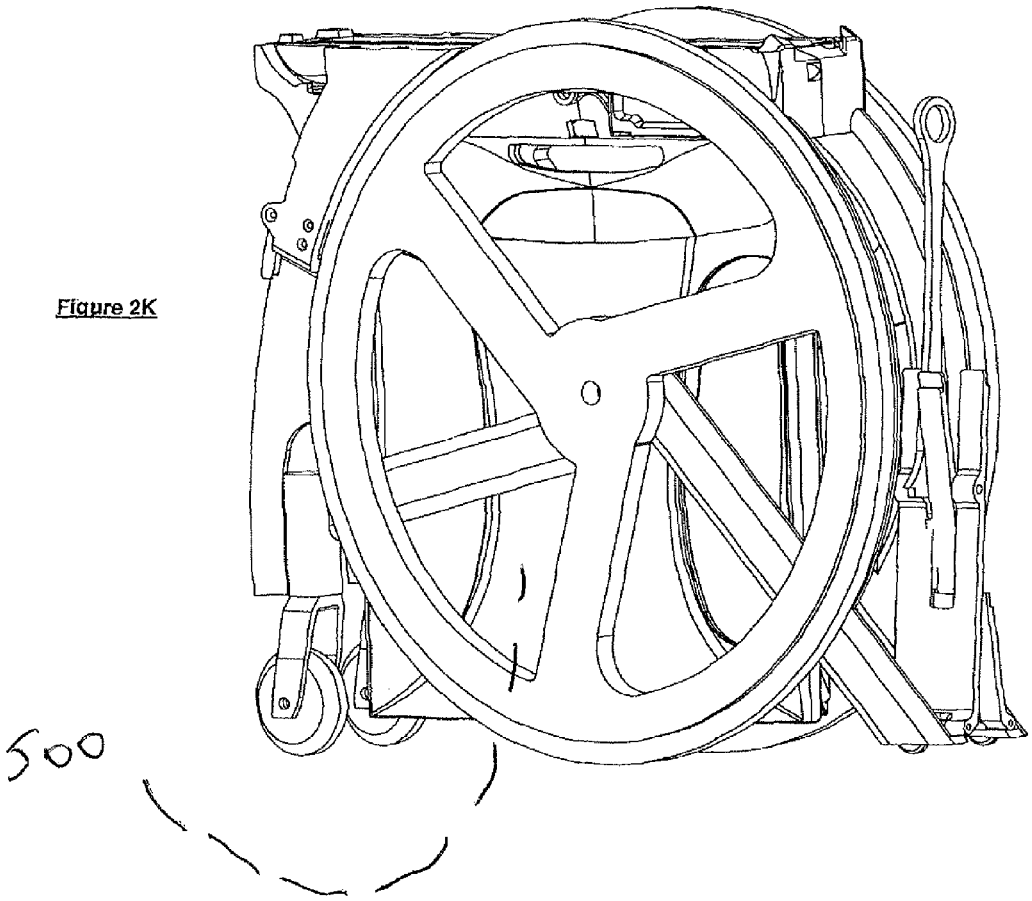

According to some embodiments of the present invention, the legrest [400] may be comprised of two rigid bars connected to each other at the center of the legrest by a folding joint [415], and connected at each side to the end of one of the two side front lower horizontal bars, also by folding joints [see FIG. 2J]. According to further embodiments of the present invention, the legrest may also include a vertical handle [450], attached roughly to the center of the legrest and adapted to facilitate the folding of the legrest, i.e. by pulling the handle upwards a user may cause the legrest to fold. The structure and position of the legrest may provide structural support to the chassis in its open state.

According to some embodiments of the present invention, the detachable folding seat and backrest assembly/component. [500] (SBC) may be comprised of a seat [520] and backrest [510] [see FIGS. 6A-6B], fabricated from rigid materials, such as titanium, aluminum, fiberglass, carbon fiber, other reinforced plastics, any other appropriate material and/or any combination thereof. According to further embodiments of the present invention, the SBC may be further comprised of softer materials, such as rubber, cloth, foam, etc. located in those portions of the SBC where a user is intended to sit or lean on, in order to provide comfort to the user.

Figure 21:
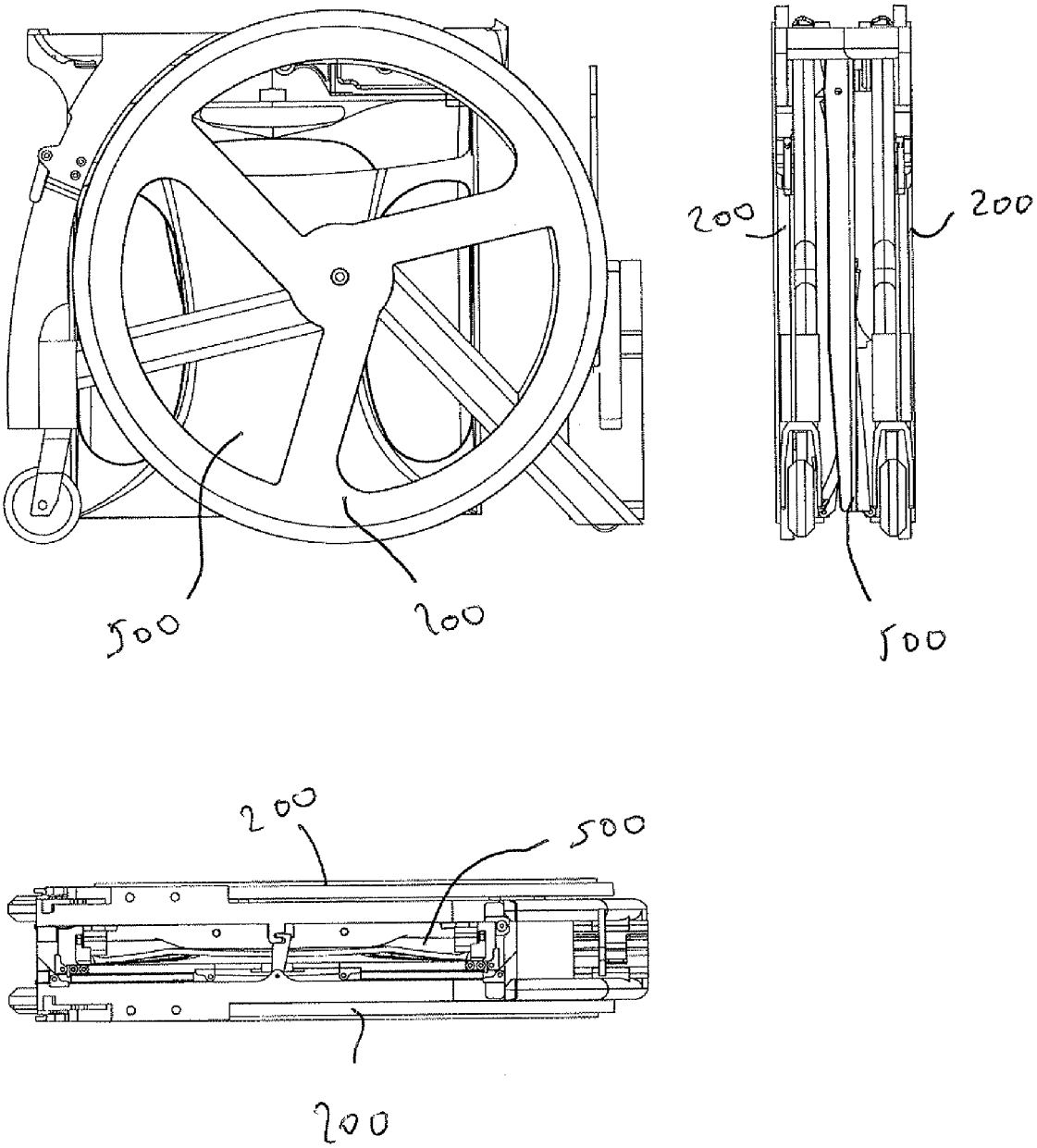

The seat and backrest may be connected on one side by a folding joint (hinges), such that the SBC when folded forms a flat rectangle [see FIG. 2H-#500], which may fit inside the chassis in its folded state [see FIG. 21] and when unfolded forms an "L" shaped seat and backrest component [see FIG. 6A], which may be adapted to connect and disconnect to the top of the chassis [see FIGS. 6C-6I], such that the seat portion sits on top of the chassis [see FIG. 2A] when connected.

According to some embodiments of the present invention the SBC may connect to the top rear of the chassis with a "locking" connector (hereby: "LC1") According to further embodiments of the present invention, the chassis may include slots [see FIG. 6C] or a similar mechanism to secure the front of the SBC to the front of the chassis when the SBC is connected to the chassis. Furthermore, one of the side top horizontal bars, may include hooks on its inner side [190] corresponding to holes in the SBC [580] to facilitate hanging the folded SBC inside the chassis before collapsing/folding the chassis. The SBC may further include a handle or opening [570] suitable for gripping the SBC in its folded state and placing and removing the SBC to and from its position inside the chassis. Optionally, the SBC may include other protrusions, knobs, slots, etc., adapted to secure the SBC in place when connected to the chassis and/or to facilitate proper placement of the SBC.

According to some embodiments of the present invention, as the seat is a rigid square, when connected to the chassis it may provide structural support to the chassis and may "lock" the chassis open, i.e. the SBC, when connected to the chassis, may inhibit the chassis from collapsing/folding. As a result, it may be necessary to disconnect the SBC from the chassis in order to allow folding/collapsing of the chassis. According to further embodiments of the present invention, the folding joint between the seat and backrest in combination with the LC1 [see FIGS. 2B-2C and 6C-6I] may be designed such that:

a. the SBC can only be connected and disconnected to and from the chassis in its folded state, i.e. the SBC must first be folded before it can be connected or disconnected to and from the chassis. As a result, when the SBC is connected to the chassis and opened, the connection to the chassis [see FIG. 61] may "lock"; and b. when the SBC is connected to the chassis and opened, the joint between the seat and backrest [see FIG. 61] may also lock open and further, the SBC may need to be lifted slightly to allow it to be folded again [see FIG. 2B-2C], effectively preventing the backrest from folding onto the seat when there is any weight on the seat, i.e. when a user is sitting on the CW.

Accordingly, the process of connecting the SBC to the chassis may entail (1) sliding the front of the SBC into the appropriate slots in the front of the chassis [see FIGS. 6C-6D]; (2) connecting the LC 1 to the rear of the chassis [see FIGS. 6E-6G], which may result in the chassis being locked open; and (3) opening the SBC, i.e. unfolding the SBC [see FIG. 6H-6I], which may result in the connection between the SBC and the chassis locking and the SBC being locked open. The process of disconnecting the SBC from the chassis may entail (1) slightly lifting the rear of the SBC [see FIG. 2B] (unlocking the joint connecting the seat to the backrest); (2) folding the SBC [see FIG. 2C-2E] (unlocking the connection between the SBC and the chassis); and (3) disconnecting the rear of the SBC from the chassis and sliding it out of the slots in the front of the chassis [see FIG. 2F] (allowing the chassis to be collapsed/folded). As a result, when all is open, the weight of a user sitting on the seat may prevent the SBC from being folded, which may prevent the SBC from being disconnected from the chassis, which in turn may prevent the chassis from folding/collapsing. In other words, once the SBC is properly connected to the chassis and opened, the weight of a user sitting on the CW may lock the entire CW in its open state.

According to some embodiments of the present invention, a user seated next to the CW may collapse the CW, while remaining in a seated position, by performing the following steps:

a. Disconnecting the SBC from the chassis, as described above [see FIGS. 2B-2F];

b. Placing the SBC on the appropriate hooks inside the chassis [see FIG. 2H];

c. Pulling up on the legrest handle, thereby causing the legrest to begin folding [see FIG. 2J];

d. Releasing the front and rear horizontal bar joints [see FIG. 2J];

e. Pulling the sides of the chassis towards each other until the chassis is fully collapsed [see FIG. 2K]; and f. Closing the clasp [see FIG. 11] (described below).

Conversely, a user seated next to a collapsed CW may expand the CW, from the seated position, by performing the following steps:

a. Opening the clasp (described below).

b. Pushing the sides of the chassis apart until the chassis is fully open;

c. Locking the front and rear horizontal bar joints;

d. Removing the SBC from inside the chassis; and e. Connecting the SBC to the chassis, as described above.

According to further embodiments of the present invention, the seat portion of the SBC [520] may include an opening [550] which may be roughly oval in shape (similar to a toilet seat) and may be covered by a trap door [540]. The trap door may be connected to the seat with a hinge (which may optionally be spring assisted), such that when actuated, the trap door opens forward and downward [see FIG. 6B] to hang down vertically from the front portion of the seat, leaving a toilet like opening in the seat. Thus, if the trapdoor is first opened and the CW is then driven backwards to stand over a toilet [see FIG. 3B], the trapdoor will remain outside the toilet (in front of the toilet), whereas the opening in the seat [550] will be located directly above the toilet, allowing a user seated on the CW to use the toilet. According to further embodiments of the present invention, the trap door may be actuated by a handle [530] located within reach of a user sitting on the seat, e.g. on the front of the seat.

According to some embodiments of the present invention, the CW may include two small front wheels [600], fabricated from rubber, titanium, aluminum, fiberglass, carbon fiber, other reinforced plastics, any other appropriate material and/or any combination thereof. The front wheels may be connected to the legrest, directly beneath it, possibly on the sides of the legrest or in any other location that will not interfere with the folding motion of the legrest. Alternatively, the front wheels may be connected to the bottom of the side front horizontal bars [see FIG. 8A]. According to further embodiments of the present invention, a CW without the small front wheels may be provided. In such embodiments the front wheels may be replaced with another component designed to prevent the CW from tipping over forwards. For example, the CW may further comprise anti-tipping bars [see FIG. 8A*—detail F], located under the legrest or beneath the front of the side front lower horizontal bars. The anti-tipping bars may protrude downwards from the legrest or side front lower horizontal bars, to reach close to the ground without touching it, such that when the CW is moving forwards the anti-tipping bars do not interfere (touch the ground), whereas when the CW begins to tip forwards, the anti-tipping bars reach the ground and prevent the CW from continuing to tip forwards. According to further such embodiments, the anti-tipping bars may be connected to the legrest or side front lower horizontal bars with a hinged connection, such that they resist force coming from below (during a tipping forward of the CW) while bending forwards or backwards in response to a force coming from the front or rear, such as when an obstacle is driven into (e.g. a curb or other protrusion from the ground). In this fashion, the anti-tipping bars may prevent the CW from tipping forwards without reducing the clearance height of the front of the CW.

According to some further embodiments of the present invention, the CW may include optional detachable armrests [700], which may connect to pre-fabricated holes in the top side horizontal bars [see FIG. 9A]. The armrests, when connected to the chassis, may be situated such that they block the backrest from folding [see FIG. 9B], so that they must be removed prior to commencing folding/collapsing of the CW.

According to some embodiments of the present invention, the CW may further include brakes [see FIG. 10, detail I] of any type known today or to be devised in the future. The brakes may be designed to be operated by a user sitting on the CW.

According to yet further embodiments of the present invention, the CW may also include a clasp [199], designed to "lock" the chassis in its folded state [see FIG. H].

It should be understood by one of ordinary skill in the art, that the above described combination of discreet elements is one of many possible combinations of elements possible to fabricate an aircraft wing spar or any other structural element desired, in accordance with the principles of this invention.

It should also be understood by one of skill in the art that some of the functions described as being performed by a specific component of the system may be performed by a different component of the system in other embodiments of this invention.

The present invention can be practiced by employing conventional tools, methodology and components. Accordingly, the details of any such tool, component and methodology are not set forth herein in detail. In the previous descriptions, numerous specific details are set forth, in order to provide a thorough understanding of the present invention. However, it should be recognized that the present invention may be practiced without resorting to the details specifically set forth.

In the description and claims of embodiments of the present invention, each of the words, "comprise" "include" and "have", and forms thereof, are not necessarily limited to members in a list with which the words may be associated.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

EXEMPLARY EMBODIMENTS

The following is a description of some specific exemplary implementations of the present invention. These following specific exemplary embodiments of the present invention are presented to further clarify the present invention and the possible implementations of its principles, and as such, should not be understood to encompass the full scope of the present invention in any way. It should be clear to anyone of ordinary skill in the art that many other implementations of the present invention are possible.

According to some embodiments of the present invention, an exemplary CW (hereinafter: "ECW") may be provided [see FIGS. 1 A-ID], which ECW, in its closed state, forms a flat squarelike form 60 cm long, 50 cm wide, and 13 cm deep (thick) [see FIG. 2L]. The ECW, in its open state, may be 60 cm long at its longest point, 41 cm wide at its widest point and 89 cm high with the seat level being 51 cm high. The ECW may weigh 8.5 kg, all together.

The ECW may be comprised of:

a. A chassis [100];
b. Two large driving wheels [200];
c. Two small rear wheels [300];
d. A folding leg rest [400];
e. A detachable seat and backrest assembly/component [500];
f. Two small front wheels [600];
g. Detachable optional armrests [700];
h. Two brakes [see FIG. 10]; and/or
i. Miscellaneous connectors and ancillary parts.

The chassis of the ECW may be comprised of multiple rigid bars connected by a combination of rigid and folding joints, to form a cubelike construct [see FIG. 4A] which can be folded/collapsed into a flat squarelike form [see FIG. 4D].

Each side of the chassis of the ECW may be comprised of:

a. a side top horizontal bar [110] roughly 45 cm long, 4 cm wide (at its widest point) and 2 cm thick. The top side horizontal bars may be fiat on their top surface and curved on their bottom surface so as to match the contour of the circumference (outer rim) of the large driving wheels [see FIGS. 5B-5E];
b. a rear vertical bar [120] roughly 37 cm long, 18 cm wide (at its widest point) and 1.5 cm thick. The rear vertical bar may be connected to the side top horizontal bar towards the rear of the top side horizontal bar [110] and may be curved and/or have a curved inner surface to match the contour of the circumference (outer rimO of the large driving wheels [see FIGS. 5B-5E];
c. a side rear lower horizontal bar [160] roughly 24 cm long, 4.5 cm wide and 2 cm thick. The side rear lower horizontal bar may be connected to the lower portion of the rear vertical bar [120] and run at a slightly upward angle to a wheel connection [180] located roughly at the center of the side of the chassis;
d. a side front lower horizontal bar [170] roughly 19 cm long, 4.5 cm wide and 2 cm thick. The side front lower horizontal bar may be connected to said wheel connection [180], roughly opposite the side rear lower horizontal bar and run forwards at a slightly downward angle; and/or
e. a front vertical bar [130] curved and roughly 23 cm long, 4.5 cm wide and 2 cm thick. The curved front vertical bar may be connected to the front of the side top horizontal bar [110] and run downwards at a curve matching the contour of the circumference (outer rim) of the large driving wheels [200] to meet and connect to the side lower front horizontal bar, slightly forwards from midway along the side lower front horizontal bar [see FIGS. 4 A+4D].

The sides of the chassis of the ECW may be connected to each other by: (1) two folding front and rear horizontal bars [150+140, respectively], connected, by folding joints, to the front and rear, respectively, of each side top horizontal bar [110]; and (2) the folding leg rest [400], which may be connected, by folding joints, to the front ends of each of the side lower front horizontal bars [170]. Both the two folding front and rear horizontal bars and the leg rest may each be comprised of two rigid bars connected at the center by a folding joint [115+415, respectively]. The leg rest, however, may be connected with its wider surface pointed upwards (horizontally—for a user to place his/her feet) [see FIG. 2J] such that it folds upward, whereas the front and rear horizontal bars may be connected with their wider surface pointed inwards (vertically), such that they fold inwards [see FIG. 2J].

Thus the chassis of the ECW in its open state may comprise the two sides, separated by two horizontal bars connecting the top two corners and the leg rest connecting the bottom front corners [see FIG. 2I]. Further, the chassis of the ECW may fold/collapse inward and expand/unfold outward when the leg rest folds/unfolds upward/downward and the front and rear horizontal bars fold/unfold inward/outward. The leg rest may further include a vertical handle [450] adapted to facilitate and/or initiate the folding of the leg rest. The folding/unfolding of the horizontal bars may be facilitated by actuating an element of the relevant joint, such as a magnetic clasp.

The small front wheels of the ECW [600] may have a diameter of 3 cm, a width of 1 cm and may be connected to the bottom of the side lower front horizontal bars, such that they sit directly beneath the sides of the leg rest [see FIG. 8A]. According to further embodiments of the present invention, the front wheels may be connected such that a top portion of the wheels is located inside the side lower front horizontal bars [see FIG. 8A, detail F].

The chassis components of the ECW may be fabricated from aluminum, carbon fiber, fiberglass, titanium, any other sufficiently rigid material and/or any combination thereof.

The large driving wheels [200] of the ECW may have a diameter of roughly 50 cm, be roughly 1.6 cm thick and may each be comprised of a hub, spokes and an outer rim. The hubs [210] may include axles or female axles adapted to connect to the wheel connector [180] on each side of the chassis, such that the top of the chassis is roughly level with the top of the large driving wheels. The construction of the ECW, with the two driving wheels connected on the center of each side such that the center of the ECW is roughly between the driving wheels [see FIG. 12], will result in the ECW being able to turn in place or nearly so, similar to a tank.

The spokes [230] of the large driving wheels of the ECW may be fiat bars roughly 14 cm long, 4.5 cm wide and 1.6 cm thick, and designed such that they are comfortable to grip with a hand. It should be noted that the area inside the large driving wheels [166], is unobstructed above the side lower horizontal bars due to the fact that the contours of the front vertical bars, the rear vertical bars and the side top horizontal bars match the contour of the large driving wheels. It is therefore possible for a user of the ECW to propel and maneuver the ECW by using the spokes to turn the large driving wheels without fear of "catching/pinching" his/her hands.

The outer rim of the large driving wheels of the ECW may contact the chassis in multiple locations [see FIGS. 5B-5E] around the circumference of the outer rim, such that the driving wheels provide structural strength, such as lateral support, to the chassis and vice versa. For example, the outer rim, when the large driving wheels are connected to the chassis, may contact the side top horizontal bar in two places (front and back) [see FIGS. 5D-5E], and both of the side lower horizontal bars [see FIGS. 5D-5E].

The small rear wheels of the ECW [300] may have a diameter of 7 cm, a width of 2.5 cm and may be connected to the bottom of the rear vertical bars [see FIG. 8A], such that they are level or nearly level with the rear of the large driving wheels.

The detachable seat and backrest component/assembly of the ECW (hereinafter: "ESBC") [500] may be comprised of a seat [520] and a backrest [510] connected on one end by a folding joint [see FIG. 6A]. The backrest [510] may be a flat rectangle 38 cm×40 cm fabricated from aluminum, carbon fiber, fiberglass, titanium, any other sufficiently rigid material and/or any combination thereof. The backrest may include holes/spaces in its surface [590], while remaining with sufficient surface and a frame to maintain the backrest shape. This may reduce the weight of the backrest. The seat may be a flat rectangle 37 cm×45 cm fabricated from aluminum, carbon fiber, fiberglass, titanium, any other sufficiently rigid material and/or any combination thereof. The seat may include an opening [550], which may be roughly oval in shape (similar to a toilet seat) 26 cm long and 21 cm wide, which opening may be covered with a trapdoor [540]. The trap door may be connected to the seat with a hinge which, optionally, may be spring assisted, such that when actuated, the trap door opens forward and downward [see FIG. 6B] to hang down vertically from the front portion of the seat, leaving a toilet like opening in the seat. Thus, if the trapdoor is first opened and the CW is then driven backwards to stand over a toilet, the trapdoor will remain outside the toilet (in front of the toilet) [see FIG. 3B], whereas the opening in the seat [550] will be located directly above the toilet, allowing a user seated on the CW to use the toilet. The trap door may be actuated by a handle [530] located within reach of a user sitting on the seat, e.g. on the front of the seat.

According to further embodiments of the present invention, both the seat and the backrest may be further comprised of softer materials, such as rubber, cloth, foam, etc. located in those portions of the ESBC where a user is intended to sit or lean on, in order to provide comfort to the user.

The seat and backrest may be connected on one side by a folding joint (hinges), such that the ESBC when folded [see FIG. 2H] forms a flat rectangle 45 cm×37 cm, which may fit inside the chassis in its folded state [see FIG. 6J] and when unfolded forms an "L" shaped seat and backrest component [see FIG. 6A], which may be adapted to connect and disconnect to the top of the chassis [see FIGS. 6C-6I], such that the seat portion sits on top of the chassis [see FIG. 2A] when connected.

The ESBC may connect to the top rear of the chassis with a "locking" connector (hereby: "ELC1"). The chassis may include slots [see FIG. 6C] or a similar mechanism to secure the front of the ESBC to the front of the chassis when the ESBC is connected to the chassis. Furthermore, one of the side top horizontal bars, may include hooks on its inner side [190] corresponding to holes in the ESBC [580] to facilitate hanging the folded SBC inside the chassis before collapsing/folding the chassis. The ESBC may further include a handle or opening suitable for gripping the ESBC in its folded state and placing and removing the SBC to and from its position inside the chassis. Optionally, the ESBC may include other protrusions, knobs, slots, etc., adapted to secure the ESBC in place when connected to the chassis and/or to facilitate proper placement of the SBC.

As the seat is a rigid rectangle, when connected to the chassis it may provide structural support to the chassis and may "lock" the chassis open, i.e. the ESBC, when connected to the chassis, may inhibit the chassis from collapsing/folding. As a result, it may be necessary to disconnect the ESBC from the chassis in order to allow folding/collapsing of the chassis. The folding joint between the seat and backrest in combination with the ELC1 [see FIGS. 2B-2C and 6C-6I] may be designed such that:

a. the ESBC can only be connected and disconnected to and from the chassis in its folded state, i.e. the ESBC must first be folded before it can be connected or disconnected to and from the chassis. As a result, when the ESBC is connected to the chassis and opened, the connection to the chassis [see FIG. 61] may "lock"; and b. when the ESBC is connected to the chassis and opened, the joint between the seat and backrest [see FIG. 61] may also lock open and further, the ESBC may need to be lifted slightly to allow it to be folded again, effectively preventing the backrest from folding onto the seat when there is any weight on the seat, i.e. when a user is sitting on the ECW.

Accordingly, the process of connecting the ESBC to the chassis may entail (1) sliding the front of the ESBC into the appropriate slots in the front of the chassis [see FIGS. 6C-6E]; (2) connecting the ELC1 to the rear of the chassis [see FIGS. 6F-6G], which may result in the chassis being locked open; and (3) opening the ESBC, i.e. unfolding the ESBC [see FIG. 6H-61], which may result in the connection between the ESBC and the chassis locking and the ESBC being locked open. The process of disconnecting the ESBC from the chassis may entail (1) slightly lifting the rear of the ESBC [see FIG. 2B] (unlocking the joint connecting the seat to the backrest); (2) folding the ESBC [see FIG. 2C-2E] (unlocking the connection between the ESBC and the chassis); and (3) disconnecting the rear of the ESBC from the chassis and sliding it out of the slots in the front of the chassis [see FIG. 2F] (allowing the chassis to be collapsed/folded). As a result, when all is open, the weight of a user sitting on the seat may prevent the ESBC from being folded, which may prevent the ESBC from being disconnected from the chassis, which in turn may prevent the chassis from folding/collapsing. In other words, once the ESBC is properly connected to the chassis and opened, the weight of a user sitting on the ECW may lock the entire ECW in its open state.

A user seated next to the ECW may collapse the ECW, while remaining in a seated position, by performing the following steps:

a. Disconnecting the ESBC from the chassis, as described above [see FIGS. 2B-2F];

b. Placing the ESBC on the appropriate hooks inside the chassis [see FIG. 2H];

c. Pulling up on the leg rest handle, thereby causing the leg rest to begin folding [see FIG. 2J];

d. Releasing the front and rear horizontal bar joints [see FIG. 2J];

e. Pulling the sides of the chassis towards each other until the chassis is fully collapsed [see FIG. 2K]; and f. Closing the clasp [see FIG. 10] (described below).

Conversely, a user seated next to a collapsed ECW may expand the ECW, from the seated position, by performing the following steps:

a. Opening the clasp (described below).

b. Pushing the sides of the chassis apart until the chassis is fully open;

c. Locking the front and rear horizontal bar joints;

d. Removing the ESBC from inside the chassis; and e. Connecting the ESBC to the chassis, as described above.

According to some further embodiments of the present invention, the ECW may include optional detachable armrests [700], which may connect to pre-fabricated holes in the top side horizontal bars [see FIG. 9A]. The armrests, when connected to the chassis, may be situated such that they block the backrest from folding [see FIG. 9B], so that they must be removed prior to commencing folding/collapsing of the ECW.

According to some embodiments of the present invention, the ECW may further include a manual brake mechanism, connected to the rear vertical bar on each side [see FIG. 10, detail I]. The brakes may be comprised of rigid horizontal pins roughly 1 cm long, which pins can be moved forward and backwards by maneuvering a lever connected to the pins. Said pins, when moved forward may apply pressure to the outer rim of the large driving wheels, effectively inhibiting the rotation of the driving wheels, and thus serving as brakes for the ECW. Obviously, moving the pins backwards may retract them from the driving wheels, effectively releasing the pressure from the driving wheels and thus allowing the driving wheels to rotate freely, i.e. releasing the brakes. The brake may be designed to be operated by a user sitting on the ECW, i.e. located within reach of a seated user.

The ECW may also include a clasp [199], designed to "lock" the chassis in its folded state [see FIG. H].

FIG. 13 is a diagram of a collapsible wheelchair, in accordance with one embodiment of the present invention, showing driving wheels 200 situated beneath the seat 520, the driving wheels 200 having large diameter rims 220 (see FIG. 13A) and a tire 222. As seen in FIG. 13 and FIG. 13A, a smaller diameter outer rim 221 without a tire may be situated beyond the width of the seat 520. As shown in FIG. 13, in some preferred embodiments of the invention, the unfolded position of the wheelchair is such that the tire of the driving wheels are situated beneath the seat. Accordingly, even in the unfolded position, no portion of the contact portion of the driving wheels 200 (the portion in contact with the floor during movement of the wheelchair), which contact portion may be the tire of the driving wheel, may extend outward beyond an imaginary plane perpendicular to the side of the seat, the imaginary plane running from either side edge of the seat to the floor. To ensure this result, the width of the seat 520 may be configured to exceed the sum of the width of the space between the two driving wheels 200 plus the width of the two large diameter rims 220 (see FIG. 13A) or plus the width of the tires since the rims have tires on them. Other portions of the driving wheels 200, for example the area of the driving wheels used for propelling the driving wheels, may extend out beyond this imaginary plane (beyond the side edges of the seat) since they do not contact the floor and they are used for propelling the driving wheels. In this way, moreover, the user may propel the driving wheels without even accidentally touching the inner rims or tires of the driving wheels. This addresses and solves the problem of people in wheelchairs moving their wheelchairs into a public bathroom with a wet or dirty floor and then when the tire or rim of the driving wheels of the wheelchair accumulates dirt and bacteria from the floor of the public bathroom, and then circles up and around, they may accidentally touch that dirt with his hands or garments. In the present invention, the tire or rim of the driving wheel, which may be dirty, are situated beneath the seat and are not exposed to any parts of the body of the person sitting in the wheelchair or propelling the driving wheels of the wheelchair.

It should be understood that the above exemplary embodiments are intended solely to exemplify the principles and teachings of the present invention and therefore, should not be considered to encompass the full scope of the present invention in any way. It should be clear to anyone of ordinary skill in the art that many other examples of the present invention are possible.

What is claimed is:

1. A wheelchair comprising:

a chassis having side bars;

a pair of driving wheels connected to the side bars of said chassis such that, when the wheelchair is in a non-collapsed position and configured to allow a user to sit on a seat of said wheelchair: (1) the center of gravity of said wheelchair is located at a point between the hubs of said driving wheels or behind said point; and (2) the center of a minimal enclosing circle of said wheelchair is located substantially between said driving wheels, the driving wheels contacting the floor when the wheelchair moves along the floor, wherein each of the driving wheels is on a side of the chassis and does not extend in front of or behind the chassis;

a pair of small rear wheels rearward of the pair of driving wheels and in contact with the floor when the wheelchair is propelled along the floor;

wherein said side bars include at least one lower bar and at least one curved bar having a curve matching the contour of the circumference of the driving wheels, and wherein each driving wheel includes hub at the center thereof for connecting the driving wheels to the lower bars and further includes an outer rim defined at the circumference of the driving wheel, said outer rim contacts the curved bar in multiple contact points providing the driving wheel with lateral support from the curved bar and a tire that contacts the floor when the wheelchair moves along the floor, the tire positioned beneath the seat when the wheelchair moves along the floor.

2. The wheelchair according to claim 1, wherein the driving wheels are connected substantially at a center of a length of each side of the wheelchair.

3. The wheelchair according to claim 1, wherein when the wheelchair turns, the wheelchair is configured to rotate around the center of the minimal enclosing circle.

4. The wheelchair according to claim 1, wherein the seat is substantially level with a top of each said driving wheel.

5. The wheelchair according to claim 1, wherein said wheelchair is configured to be collapsed and expanded by a user seated next to said wheelchair.

6. The wheelchair of claim 1, wherein the wheelchair is no more than 50 cm wide at its widest point.

7. The wheelchair of claim 1, wherein the chassis and the pair of driving wheels arranged such that the wheelchair can be maneuvered backwards over a toilet by a user seated on said wheelchair.

8. The wheelchair of claim 1, wherein the chassis may further include an intermediary element connected to the chassis at the contact points.

9. The wheelchair of claim 8, wherein the intermediary element includes bearing.

10. The wheelchair of claim 1, wherein the at least one lower bar includes a front lower bar and a rear lower bar coupled to one another at a wheel connection to which said hub is mounted.

* * * * *